US011933299B2

(12) United States Patent
Wilson et al.

(10) Patent No.: US 11,933,299 B2
(45) Date of Patent: Mar. 19, 2024

(54) DUAL DRIVE CO-ROTATING SPINNING SCROLL COMPRESSOR OR EXPANDER

(71) Applicant: Air Squared, Inc., Thornton, CO (US)

(72) Inventors: John P. D. Wilson, Denver, CO (US); Nathan D. Nicholas, Westminster, CO (US)

(73) Assignee: Air Squared, Inc., Thornton, CO (US)

( * ) Notice: Subject to any disclaimer, the term of this patent is extended or adjusted under 35 U.S.C. 154(b) by 0 days.

(21) Appl. No.: 17/972,165

(22) Filed: Oct. 24, 2022

(65) Prior Publication Data

US 2023/0050093 A1 Feb. 16, 2023

Related U.S. Application Data

(62) Division of application No. 16/514,639, filed on Jul. 17, 2019, now abandoned.

(Continued)

(51) Int. Cl.

| | |
|---|---|
| ***F04C 18/02*** | (2006.01) |
| ***F04C 29/00*** | (2006.01) |
| ***F04C 29/02*** | (2006.01) |

(52) U.S. Cl.

CPC ..... *F04C 18/023* (2013.01); *F04C 29/0085* (2013.01); *F04C 29/02* (2013.01)

(58) Field of Classification Search

CPC .. F04C 15/008; F04C 18/023; F04C 29/0085; F04C 29/02; F04C 29/12

(Continued)

(56) References Cited

U.S. PATENT DOCUMENTS

| | | | |
|---|---|---|---|
| 801,182 | A | 10/1905 | Creux |
| 2,079,118 | A | 5/1937 | Hingst |

(Continued)

FOREIGN PATENT DOCUMENTS

| | | |
|---|---|---|
| CN | 1314899 | 5/2007 |
| CN | 103790826 | 5/2014 |

(Continued)

OTHER PUBLICATIONS

"Digital Scroll Compressor Technology," Wikipedia, 2010, 3 pages [retrieved online from: en.wikipedia.org/wiki/Digital_Scroll_Compresso_Technology].

(Continued)

*Primary Examiner* — Charles G Freay
*Assistant Examiner* — Chirag Jariwala
(74) *Attorney, Agent, or Firm* — Sheridan Ross P.C.

(57) ABSTRACT

A dual-drive co-rotating scroll device includes a housing; a first scroll rotatably mounted within the housing via a first cylindrical extension and a first plurality of bearings, and having a first axis of rotation; and a second scroll rotatably mounted within the housing via a second cylindrical extension and a second plurality of bearings, and having a second axis of rotation different than the first axis of rotation. At least one of the first cylindrical extension and the second cylindrical extension may comprise a plurality of permanent magnets and operate as a rotor of a first motor. An Oldham ring may be positioned between the first scroll and the second scroll and configured to maintain a relative angular position between the first scroll and the second scroll.

18 Claims, 13 Drawing Sheets

Related U.S. Application Data

(60) Provisional application No. 62/834,157, filed on Apr. 15, 2019, provisional application No. 62/816,715, filed on Mar. 11, 2019, provisional application No. 62/699,536, filed on Jul. 17, 2018.

(58) Field of Classification Search
USPC ..... 418/55.1; 417/410.5
See application file for complete search history.

(56) References Cited

U.S. PATENT DOCUMENTS 2,330,121 A 9/1943 Heintz
2,475,247 A 7/1949 Mikulasek
2,968,157 A 1/1961 Cronan
3,011,694 A 12/1961 Mulhouse et al.
3,262,573 A 7/1966 Schutte
3,470,704 A 10/1969 Kantor
3,600,114 A 8/1971 Miloslav et al.
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,178,143 A * 12/1979 Thelen et al. ..... F04C 15/0034 418/188
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,334,840 A * 6/1982 Teruyama ..... F04C 15/0003 29/888.023
4,340,339 A 7/1982 Hiraga et al.
4,368,802 A 1/1983 Grabill et al.
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,478,562 A 10/1984 Schippers et al.
4,511,091 A 4/1985 Vasco
4,512,066 A 4/1985 McCullough
4,515,539 A 5/1985 Etsuo
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,756,675 A * 7/1988 Kakuda et al. ..... F04C 18/023 417/410.5
4,802,831 A 2/1989 Suefuji et al.
4,832,586 A 5/1989 Emmenthal et al.
4,867,657 A 9/1989 Kotlarek et al.
4,875,839 A 10/1989 Sakata et al.
4,892,469 A 1/1990 McCullough et al.
4,911,621 A 3/1990 McCullough et al.
4,918,930 A 4/1990 Gaudet et al.
4,927,340 A * 5/1990 McCullough ..... F01C 20/22 418/57
4,990,072 A 2/1991 Guttinger
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,217,360 A 6/1993 Kawahara et al.
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Haga et al.
5,265,431 A 11/1993 Gaudet et al.
5,286,179 A 2/1994 Forni et al.
5,295,808 A * 3/1994 Machida et al. ..... F04C 18/023 417/410.5
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,358,387 A 10/1994 Suzuki et al.
5,397,223 A 3/1995 Spinler et al.
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,640,854 A 6/1997 Fogt et al.
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.

(56) References Cited

U.S. PATENT DOCUMENTS 6,022,195 A 2/2000 Gaudet et al.
6,050,792 A 4/2000 Shaffer
6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,213,970 B1 4/2001 Nelson et al.
6,283,737 B1 9/2001 Kazikis et al.
6,318,093 B2 11/2001 Gaudet et al.
6,328,545 B1 12/2001 Kazakis et al.
6,379,134 B2 4/2002 Iizuka
6,434,943 B1 8/2002 Garris
6,439,864 B1 8/2002 Shaffer
6,460,351 B2 10/2002 Gaudet et al.
6,461,113 B1 10/2002 Gaudet et al.
6,464,467 B2 10/2002 Sullivan et al.
6,511,308 B2 1/2003 Shaffer
6,623,445 B1 9/2003 Nelson et al.
6,644,946 B2 11/2003 Nakane et al.
6,663,364 B2 12/2003 Okada et al.
6,712,589 B2 3/2004 Mori et al.
6,736,622 B1 5/2004 Bush et al.
6,755,028 B2 6/2004 Gaudet et al.
6,902,378 B2 6/2005 Gaudet et al.
6,905,320 B2 6/2005 Satoh et al.
6,922,999 B2 8/2005 Kimura et al.
7,111,467 B2 9/2006 Apparao et al.
7,124,585 B2 10/2006 Kim et al.
7,144,383 B2 12/2006 Arnett et al.
7,181,928 B2 2/2007 de Larminat
7,201,568 B2 4/2007 Sakamoto et al.
7,234,310 B2 6/2007 Flynn et al.
7,249,459 B2 7/2007 Hisanaga et al.
7,297,133 B2 11/2007 Nelson et al.
7,306,439 B2 12/2007 Unami et al.
7,314,358 B2 1/2008 Tsuchiya
7,329,108 B2 2/2008 Tscuchiya et al.
7,439,702 B2 10/2008 Smith et al.
7,458,152 B2 12/2008 Sato
7,458,414 B2 12/2008 Simon
7,836,696 B2 11/2010 Uno et al.
7,861,541 B2 1/2011 Dieckmann et al.
7,906,016 B2 3/2011 Weber et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,523,544 B2 9/2013 Shaffer
8,668,479 B2 3/2014 Shaffer
8,674,525 B2 3/2014 Van Den Bossche et al.
8,858,203 B2 10/2014 Kanizumi et al.
9,022,758 B2 5/2015 Roof et al.
9,028,230 B2 5/2015 Shaffer
9,074,598 B2 7/2015 Shaffer et al.
9,115,719 B2 8/2015 Sadakata et al.
9,657,733 B2 5/2017 Chadwick et al.
9,784,139 B2 10/2017 Shaffer et al.
9,885,358 B2 2/2018 Shaffer
10,221,852 B2 3/2019 Shaffer et al.
10,400,771 B2 9/2019 Valdez et al.
10,508,543 B2 12/2019 Shaffer
10,519,815 B2 12/2019 Shaffer et al.
10,683,865 B2 6/2020 Shaffer et al.
10,774,690 B2 9/2020 Shaffer et al.
10,865,793 B2 12/2020 Shaffer et al.
10,890,187 B2 1/2021 Fukuhara et al.
11,047,389 B2 6/2021 Shaffer et al.
11,067,080 B2 7/2021 Mesward et al.
11,454,241 B2 9/2022 Shaffer et al.
11,473,572 B2 10/2022 Wilson et al.
11,530,703 B2 12/2022 Nicholas et al.
2001/0012485 A1 8/2001 Gaudet et al.
2001/0038800 A1 11/2001 Kimura et al.
2001/0043878 A1 11/2001 Sullivan et al.
2002/0011332 A1 1/2002 Oh et al.
2002/0039534 A1 4/2002 Moroi et al.
2002/0071779 A1 6/2002 Moroi et al.
2002/0094277 A1 7/2002 Gaudet et al.
2002/0104320 A1 8/2002 Gaudet et al.
2003/0017070 A1 1/2003 Moroi et al.
2003/0026721 A1 2/2003 Moroi et al.
2003/0051487 A1 3/2003 Gaudet et al.
2003/0053922 A1 3/2003 Satoh et al.
2003/0138339 A1 7/2003 Scancarello
2003/0223898 A1 12/2003 Fujioka et al.
2004/0020206 A1 2/2004 Sullivan et al.
2004/0184940 A1 9/2004 Nakane et al.
2004/0194477 A1 10/2004 Gaudet et al.
2004/0241030 A1 12/2004 Matsushima
2004/0255591 A1 12/2004 Hisanga et al.
2005/0025651 A1 2/2005 Sowa et al.
2005/0031469 A1 2/2005 Yanagisawa et al.
2005/0081536 A1 4/2005 Gaudet et al.
2005/0169788 A1 8/2005 Komai et al.
2005/0196284 A1 9/2005 Gaudet et al.
2005/0220649 A1 10/2005 Sato
2006/0016184 A1 1/2006 Simon
2006/0045760 A1 3/2006 Haller et al.
2006/0045783 A1 3/2006 Yanagisawa et al.
2006/0130495 A1 6/2006 Dieckmann et al.
2006/0216180 A1 9/2006 Yanagisawa et al.
2007/0071626 A1 3/2007 Tsuchiya et al.
2007/0098511 A1 5/2007 Kikkawa et al.
2007/0104602 A1 5/2007 Ishikawa et al.
2007/0108934 A1 5/2007 Smith et al.
2007/0172373 A1 7/2007 Ni
2007/0231174 A1 10/2007 Ishizuki
2007/0269327 A1 11/2007 Qian
2008/0159888 A1 7/2008 Nakayama et al.
2008/0193311 A1 8/2008 Helies
2008/0206083 A1 8/2008 Suefuji et al.
2009/0148327 A1 6/2009 Carter et al.
2009/0246055 A1 10/2009 Stehouwer et al.
2009/0304536 A1* 12/2009 Egawa et al. ..... F04C 23/008 417/423.14
2010/0044320 A1 2/2010 Weber et al.
2010/0111740 A1 5/2010 Ni
2010/0254835 A1 10/2010 Kane et al.
2010/0287954 A1 11/2010 Harman et al.
2011/0129362 A1 6/2011 Kameya et al.
2012/0134862 A1 5/2012 Hockliffe et al.
2012/0240847 A1 9/2012 Neufelder et al.
2013/0149179 A1 6/2013 Sato et al.
2013/0207396 A1 8/2013 Tsuboi
2013/0232975 A1 9/2013 Shaffer et al.
2014/0023540 A1 1/2014 Heidecker et al.
2014/0260364 A1 9/2014 Litch
2014/0377113 A1* 12/2014 Flenche ..... F01C 1/07 418/241
2017/0045046 A1 2/2017 Afshari
2017/0067469 A1 3/2017 Malvasi et al.
2017/0074265 A1 3/2017 Asami et al.
2017/0175736 A1* 6/2017 Craig et al. ..... F01C 21/108
2017/0284284 A1 10/2017 Takamiya
2017/0306956 A1 10/2017 Monet
2017/0321699 A1 11/2017 Kawano et al.
2019/0277289 A1* 9/2019 Yoo et al. ..... F01C 17/066
2019/0293070 A1 9/2019 Crum et al.
2019/0353162 A1 11/2019 Ishii et al.
2020/0025199 A1 1/2020 Wilson et al.
2020/0040892 A1 2/2020 Dieckmann et al.
2020/0063735 A1 2/2020 Yamashita et al.
2021/0071669 A1 3/2021 Shaffer et al.
2022/0170462 A1 6/2022 Nicholas et al.
2022/0268281 A1 8/2022 Nicholas

(56) References Cited

U.S. PATENT DOCUMENTS

FOREIGN PATENT DOCUMENTS

| | | |
|---|---|---|
| CN | 104235018 | 12/2014 |
| CN | 104632636 | 5/2015 |
| CN | 105402134 | 3/2016 |
| CN | 111765078 | 10/2020 |
| DE | 460936 | 6/1928 |
| DE | 19957425 | 8/2000 |
| EP | 341408 | 11/1989 |
| EP | 0513824 | 11/1992 |
| EP | 0780576 | 6/1997 |
| EP | 1464838 | 10/2004 |
| EP | 3239526 | 11/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | S60-135691 | 7/1985 |
| JP | S63-173870 | 7/1988 |
| JP | H02-275083 | 11/1990 |
| JP | H03-185287 | 8/1991 |
| JP | H05-157076 | 6/1993 |
| JP | H07-109981 | 4/1995 |
| JP | H07-324688 | 12/1995 |
| JP | H08-261182 | 10/1996 |
| JP | 2000-213475 | 8/2000 |
| JP | 2002-13493 | 1/2002 |
| JP | 2002-227779 | 8/2002 |
| JP | 2003-343459 | 12/2003 |
| JP | 2011-012629 | 1/2011 |
| WO | WO 2004/008829 | 1/2004 |
| WO | WO 2009/050126 | 4/2009 |
| WO | WO 2013/121900 | 8/2013 |
| WO | WO 2015/022869 | 2/2015 |
| WO | WO 2015/164453 | 10/2015 |
| WO | WO 2016/093361 | 6/2016 |
| WO | WO 2017/089745 | 6/2017 |
| WO | WO 2021/005895 | 1/2021 |

OTHER PUBLICATIONS

"Heat Pump and Refrigeration Cycle, " Wikipedia, last updated May 10, 2013, 4 pages [retrieved online from: en.wikipedia.org/wiki/Heat_pump_and_refrigeration_cycle].
"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Operating Manual: OM WGZC-2 Water-Cooled Scroll Compressor Chillers," McQuay International, 2010, 102 pages.
"Organic Rankine Cycle," Wikipedia, last modified May 19, 2013, 4 pages [retrieved online from: en.wikipedia.org/wiki/Organic_Rankine_Cycle].
"R410A // Hermetic Scroll Compressors," Bitzer, 2016, 12 pages.
"Rankine Cycle," Wikipedia, last modified Apr. 29, 2013, 4 pages [retrieved online from: en.wikipedia.org/wiki/Rankine_cycle].
"Refrigeration Technologies: scroll-compressor chillers," Misto, last modified Jan. 2013, 7 pages.
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for International (PCT) Patent Application No. PCT/US2018/064427, dated Feb. 5, 2019 14 pages.
International Preliminary Report on Patentability for International (PCT) Patent Application No. PCT/US2018/064427, dated Nov. 19, 2020 8 pages.
Official Action with English Translation for Japan Patent Application No. 2020-561761, dated Sep. 21, 2021 6 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
International Preliminary Report on Patentability for International (PCT) Patent Application No. PCT/US18/00118, dated Jun. 11, 2020 13 pages.
Official Action with English Translation for China Patent Application No. 201880077598.0, dated Aug. 12, 2021 13 pages.
Extended European Search Report for European Patent Application No. 18883031.9, dated May 3, 2021 6 pages.
Official Action with English Translation for Japan Patent Application No. 2020-548856, dated Jun. 29, 2021 10 pages.
Notice of Allowance with English Translation for Japan Patent Application No. 2020-548856, dated Nov. 2, 2021 5 pages.
Official Action for U.S. Appl. No. 16/275,943, dated Oct. 9, 2020 15 pages.
Notice of Allowance for U.S. Appl. No. 16/275,943, dated Mar. 22, 2021 12 pages.
Official Action for U.S. Appl. No. 16/514,639, dated Apr. 12, 2021 6 pages Restriction Requirement.
Official Action for U.S. Appl. No. 16/514,639, dated Jul. 9, 2021 11 pages.
Official Action for U.S. Appl. No. 16/514,639, dated Nov. 9, 2021 12 pages.
Official Action for U.S. Appl. No. 16/514,639, dated Mar. 4, 2022 26 pages.
Official Action for U.S. Appl. No. 16/514,639, dated Jun. 23, 2022 26 pages.
Official Action for U.S. Appl. No. 16/400,921, dated Jun. 4, 2021 7 pages Restriction Requirement.
Official Action for U.S. Appl. No. 16/213,111, dated Sep. 30, 2020 22 pages.
Official Action for U.S. Appl. No. 16/213,111, dated May 4, 2021 25 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.

(56) References Cited

OTHER PUBLICATIONS

Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Notice of Allowance for U.S. Appl. No. 15/330,223, dated Jan. 23, 2020 10 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 15/731,929, dated Jun. 4, 2019 10 pages.
Notice of Allowance for U.S. Appl. No. 15/731,929, dated Aug. 14, 2019 9 pages.
Official Action for U.S. Appl. No. 15/932,150, dated Nov. 25, 2019 26 pages.
Official Action for U.S. Appl. No. 15/932,150, dated Mar. 5, 2020 19 pages.
Notice of Allowance for U.S. Appl. No. 15/932,150, dated May 14, 2020 9 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 16/291,984, dated Oct. 26, 2020 12 pages.
Notice of Allowance for U.S. Appl. No. 16/291,984, dated Feb. 26, 2021 13 pages.
Official Action for U.S. Appl. No. 15/731,324, dated Feb. 7, 2019 15 pages.
Notice of Allowance for U.S. Appl. No. 15/731,324, dated Aug. 2, 2019 11 pages.
Official Action for U.S. Appl. No. 15/732,593, dated Nov. 14, 2019 7 pages Restriction Requirement.
Official Action for U.S. Appl. No. 15/732,593, dated Feb. 19, 2020 13 pages.
Notice of Allowance for U.S. Appl. No. 15/732,593, dated Aug. 13, 2020 9 pages.
Official Action for U.S. Appl. No. 15/373,979, dated Jan. 29, 2019 12 pages.
Notice of Allowance for U.S. Appl. No. 15/373,979, dated Apr. 26, 2019 9 pages.
Official Action (English Translation) for China Patent Application No. 201980029887.8, dated Dec. 3, 2021 10 pages.
Notice of Allowance with English Translation for China Patent Application No. 201980029887.8, dated Jun. 28, 2022 6 pages.
Extended European Search Report for European Patent Application No. 18917539.1, dated Jan. 4, 2022 7 pages.
Decision to Grant for Japan Patent Application No. 2020-561761, dated Feb. 15, 2022 6 pages.
Notice of Allowance with English Translation for China Patent Application No. 201880077598.0, dated Feb. 18, 2022 6 pages.
Official Action for U.S. Appl. No. 16/400,921, dated Nov. 19, 2021 24 pages.
Official Action for U.S. Appl. No. 16/400,921, dated Apr. 26, 2022 21 pages.
Notice of Allowance for U.S. Appl. No. 16/400,921, dated Aug. 18, 2022 9 pages.
Official Action for U.S. Appl. No. 16/213,111, dated Dec. 8, 2021 23 pages.
Notice of Allowance for U.S. Appl. No. 16/213,111, dated Apr. 26, 2022 10 pages.
Official Action for U.S. Appl. No. 16/950,690, dated Jan. 6, 2022 7 pages Restriction Requirement.
Official Action for U.S. Appl. No. 16/950,690, dated Mar. 17, 2022 16 pages.
Official Action for U.S. Appl. No. 16/950,690, dated Sep. 9, 2022 9 pages.
Official Action for U.S. Appl. No. 16/912,537, dated Jan. 26, 2022 15 pages.
Notice of Allowance for U.S. Appl. No. 16/912,537, dated May 25, 2022 8 pages.
Official Action for U.S. Appl. No. 17/538,999, dated Jul. 20, 2022 27 pages.
Official Action for U.S. Appl. No. 17/679,936, dated Oct. 27, 2022 16 pages.
Intention to Grant for European Patent Application No. 18883031.9, dated Jun. 30, 2023 57 pages.
Notice of Allowance for U.S. Appl. No. 16/950,690, dated Feb. 16, 2023 12 pages.
Official Action for U.S. Appl. No. 17/538,999, dated Feb. 7, 2023 20 pages.
Official Action for U.S. Appl. No. 17/538,999, dated May 24, 2023 23 pages.
Official Action for U.S. Appl. No. 17/679,936, dated Feb. 7, 2023 15 pages.
Notice of Allowance for U.S. Appl. No. 17/538,999, dated Sep. 15, 2023 10 pages.
Official Action for U.S. Appl. No. 17/967,141, dated Sep. 26, 2023 7 pages.

* cited by examiner

DUAL DRIVE CO-ROTATING SPINNING SCROLL COMPRESSOR OR EXPANDER

CROSS-REFERENCE TO RELATED APPLICATIONS

This application claims the benefit of U.S. patent application Ser. No. 16/514,639, filed Jul. 17, 2019 and entitled "Dual Drive Co-Rotating Spinning Scroll Compressor or Expander" which claims the benefit of each of U.S. Provisional Patent Application No. 62/699,536, filed Jul. 17, 2018 and entitled "Dual Drive Co-Rotating Spinning Scroll Compressor or Expander"; U.S. Provisional Patent Application No. 62/816,715, filed Mar. 11, 2019 and entitled "Dual Drive Co-Rotating Spinning Scroll Compressor or Expander"; and U.S. Provisional Patent Application No. 62/834,157, filed Apr. 15, 2019 and entitled "Dual Drive Co-Rotating Spinning Scroll Compressor or Expander." The entirety of each of the foregoing applications is hereby incorporated by reference herein for all purposes.

GOVERNMENT LICENSE RIGHTS

This invention was made with government support under DE-AR0000648 awarded by the U.S. Department of Energy. The government has certain rights in the invention.

FIELD

The present disclosure relates to scroll devices such as compressors, expanders, or vacuum pumps, and more particularly to dual drive co-rotating scroll devices.

BACKGROUND

A typical scroll compressor generally provides two scrolls to compress or pressurize fluid such as liquids and gases. A traditional orbiting scroll compressor design has one scroll which is fixed and a second scroll that orbits relative to the fixed scroll, without rotating.

Similarly, a typical scroll expander generally provides two scrolls that are used to convert energy from expanding gas into rotational energy. A traditional orbiting scroll expander design has one scroll which is fixed and a second scroll that orbits relative to the fixed scroll, without rotating.

In known scroll compressors, two co-rotating scrolls may be coupled with one another by way of idler shafts and/or a metal bellows.

SUMMARY

Co-rotating scroll compressor devices according to some embodiments of the present disclosure utilize a novel compressor design and operate at higher speeds than traditional orbiting scroll compressors. The two scroll housings have an offset center, resulting in a similar relative motion between the scrolls as in an orbiting scroll design. However, the higher operating speeds allow for a reduction in overall size when compared to a traditional orbiting design.

Idler shaft bearing failures and/or bellow failures limit the lift of traditional scroll compressors that utilize idler shafts and/or a bellows. Moreover, in scroll compressor designs that use a bellows, it can be challenging to keep the desired phasing of the two scrolls relative to one another.

Embodiments of the present disclosure may address one or more of these and/or other drawbacks of the prior art.

Although one or more aspects of the present disclosure may be illustrated with respect to a scroll compressor or a scroll expander, the present disclosure is generally applicable to and includes any type of scroll device, without limitation.

The term "scroll device" as used herein refers to scroll compressors, scroll vacuum pumps, scroll expanders, and similar mechanical devices. Persons of ordinary skill in the art will understand that basic modifications may need to made to aspects of the present disclosure to enable usage of the present disclosure with scroll expanders, which basic modifications are well within the knowledge and skill of a person of ordinary skill in the art.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. The drawings are not to be construed as limiting the disclosure to only the illustrated and described examples.

DETAILED DESCRIPTION

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

Figure 1A:
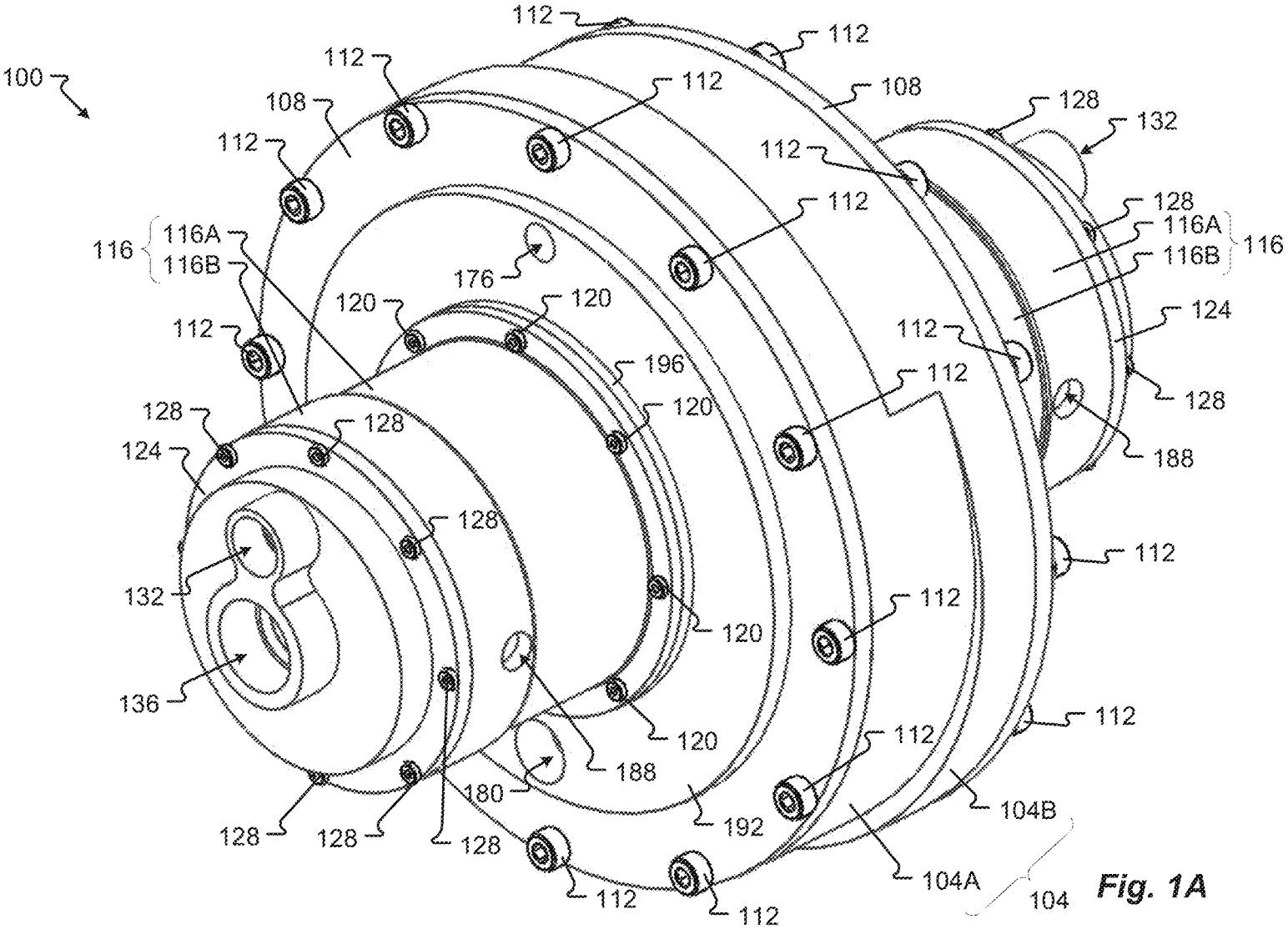
FIG. 1A is a perspective view of a co-rotating dual motor scroll device according at least some embodiments of the present disclosure.
Figure 1B:
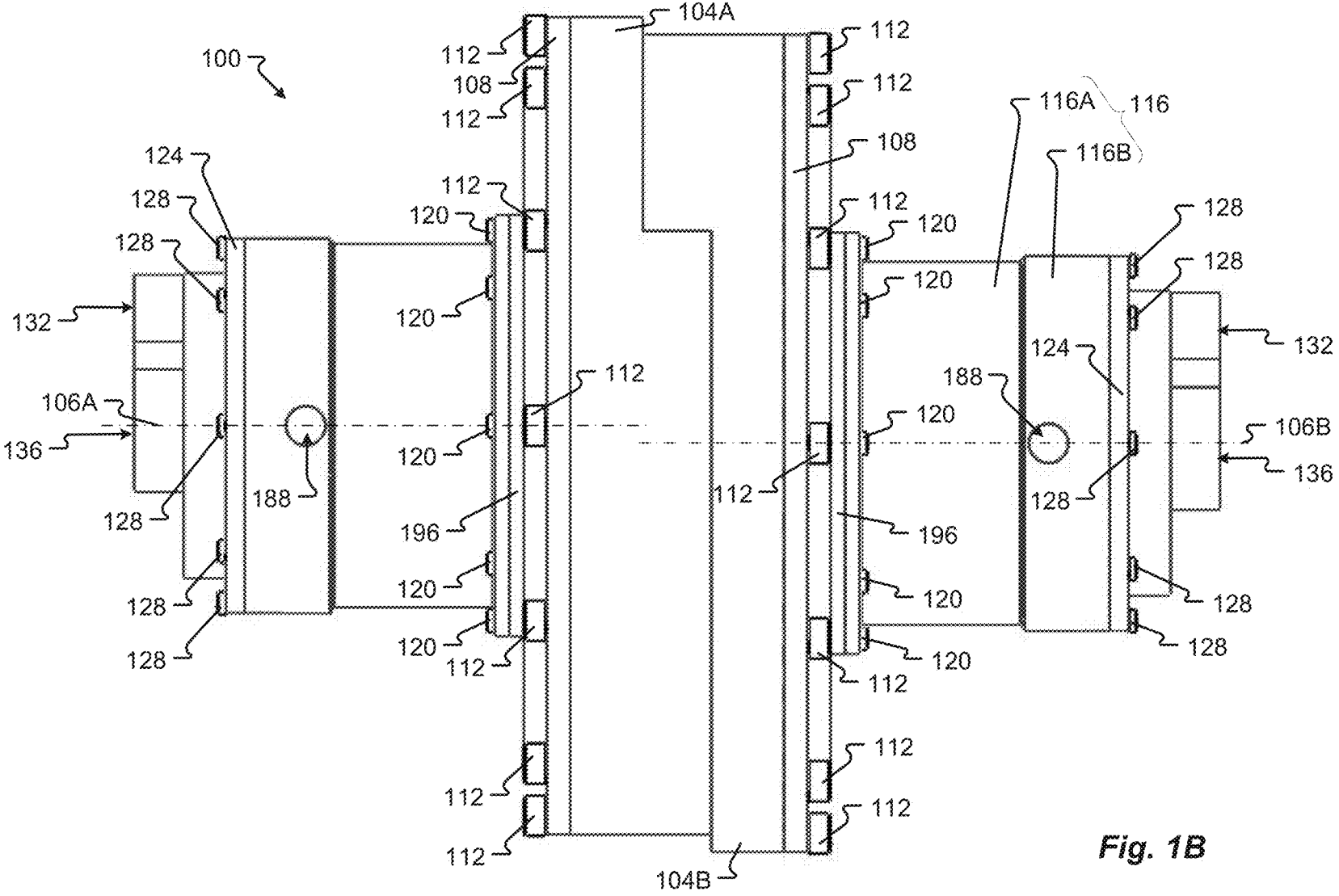
FIG. 1B is a side view of a co-rotating dual motor scroll device according to at least some embodiments of the present disclosure.
Figure 1C:
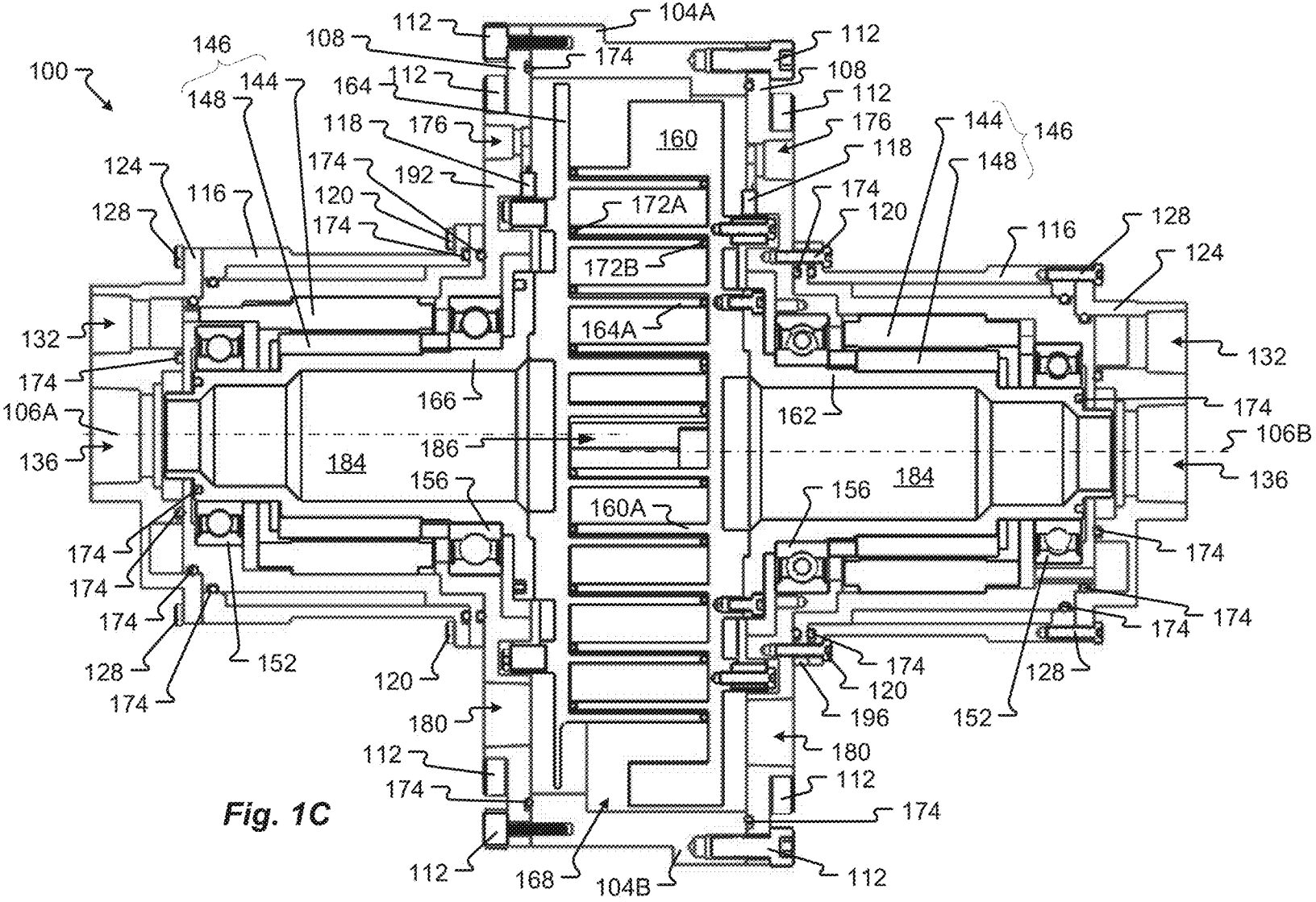
FIG. 1C is a side cross-sectional view of a co-rotating dual motor scroll device according to at least some embodiments of the present disclosure.

A dual drive co-rotating scroll device 100 is shown in FIGS. 1A-1C. As described in more detail below, the scroll device 100 specifically utilizes two motors to drive the scrolls thereof and to keep the appropriate phasing of the two scrolls. A feedback device (comprising one or more sensors) and controller are used to control the phasing of both motors. The purpose of the co-rotating scroll device 100 is to compress any gaseous operating fluid (or pump any liquid operated fluid), although the design of the scroll device 100 can be utilized for any co-rotating scroll compressor, expander or pump. Additionally, the design can be operated oil free or have oil entrained in the operating fluid.

The scroll device 100 comprises a single, central, scroll housing 104. The scroll housing 104 comprises two cylindrical portions 104A and 104B. The cylindrical portion 104A has an axis 106A, and the cylindrical portion 104B has an axis 106B that is offset from the axis of the cylindrical portion 104A. A scroll plate 108 is secured to each cylindrical portion 104A, 104B with a plurality of bolts 112 or other mechanical fasteners. The scroll housing 104 and each scroll plate 108 may be made, for example, of aluminum, an aluminum alloy, or any other metal or metal alloy. In some embodiments, the scroll housing 104 may alternatively be made of composite or another non-metallic material.

Figure 2:
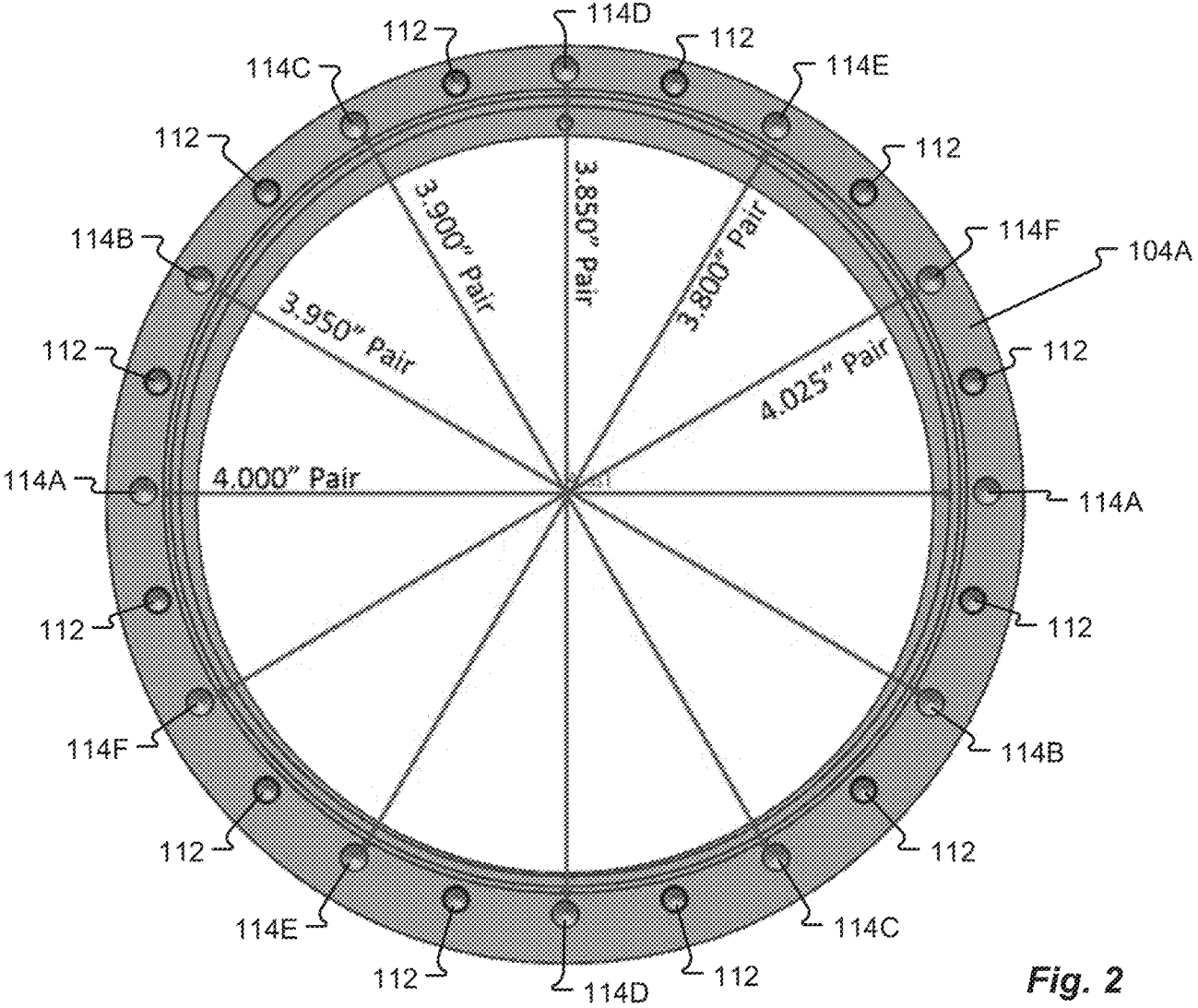
FIG. 2 is a side view of a scroll housing of a dual motor scroll device according to at least some embodiments of the present disclosure.

Turning briefly to FIG. 2, in addition to utilizing a plurality of bolts 112 or other mechanical fasteners to secure the scroll plates 108 to the scroll housing 104, in some embodiments a sets of dowel pins are used to ensure the proper positioning of each scroll plate 108 relative to the scroll housing 104, and thus to achieve fine control over the relative distance between the two orbiting scroll axes 106A and 106B. More specifically, because the fasteners 112 that mate the scroll plates 108 to the scroll housing 104 do not fully constrain the position of the scroll plates 108 (and of the rotational axes 106A and 106B of the orbiting scrolls 160 and 164), a pair of locating dowel pins may be inserted into one of the sets of dowel pin receptacles 114A, 114B, 114C, 114D, 114E, 114F. The dowel pin receptacles 114 have offset positions, such that moving the dowel pins from one set of receptacles 114 to another set of receptacles 114 will slightly adjust the position of the scroll plate 108 relative to the scroll housing 104, and thus of the corresponding scroll 160 or 164 and its axis of rotation 106A, 106B. As shown in FIG. 2, the dowel pin receptacles 114 may be arranged to alternate with the fasteners 112 around the edge of the scroll plate 108 and scroll housing 104.

Each pair of dowel pin receptacles 114 may be disposed along a line that passes through the center of the scroll plate 108, and the distance between each pair of dowel pin receptacles 114 along that line may be offset slightly relative to the distance between an adjacent pair of dowel pin receptacles 114. For example, one pair of dowel pin receptacles 114 may be five hundredths of an inch closer to each other, or farther away from each other, than an adjacent pair of dowel pin receptacles 114.

Referring again to FIGS. 1A-1C, each scroll plate 108 is stepped, so as to comprise a raised portion 192. The raised portion 192 may beneficially allow the volume enclosed within the scroll housing 104 and the scroll plate 108 to be increased, and/or may beneficially give the scroll plate 108 sufficient thickness for the machining therein of, for example, any structural features needed to support the internal components of the scroll device 100 and/or of any cooling channels or other desired internal features. The raised portion 192 also comprises a first aperture 176 and a second aperture 180. The first aperture 176 enables electrical wires to extend from an encoder located within the housing 104 to a controller positioned outside of the housing 104. The second aperture 180 may be used as a working fluid inlet. In some embodiments, however, a radial filter may separate (or be positioned over the joint between) the two cylindrical portions 104A, 104B of the housing, and the scroll device 100 may receive working fluid through the radial filter.

On each side of the scroll device 100, a plurality of bolts 120 secure a motor housing 116 and a motor mount 196 to the scroll plate 108 on that side of the scroll device 100, with a flange of the motor mount 196 positioned between the scroll plate 108 and a flange of the motor housing 116. The motor housing 116 is substantially cylindrical, with a first portion 116A proximate the scroll plate 108 and having a first outer diameter, and a second portion 116B distal from the scroll plate 108 and having a second outer diameter greater than the first outer diameter. An aperture 188 is provided in the second portion 116B. In some embodiments, motor coolant may be routed to and/or from the motor 146 via the aperture 188. The motor 146 may utilize, for example, liquid cooling to remove heat therefrom.

The larger second outer diameter of the second portion 116B provides sufficient thickness for the motor housing 116 to receive a plurality of bolts 128, which are used to secure an endplate 124 to the motor housing 116. The endplate 124 covers the end of the motor housing 116 that is distal from the scroll plate 108. Two apertures 132 and 136 are provided in the endplate 124. Wires may extend through the aperture 132 to provide electricity and/or control signals to the motor 146 positioned inside the motor housing 116 from a battery and/or controller positioned outside of the motor housing 116. The aperture 136 is a working fluid outlet.

Like the scroll housing 104, the motor housing 116, the motor mount 196, and the endplate 124 may be made, for example, of aluminum, an aluminum alloy, or any other metal, metal alloy, composite, or other suitable non-metallic material. In some embodiments, at least the motor mount 196, and possibly also one or more of the scroll housing 104, the scroll plate 108, the motor housing 116, and the endplate 124, is made of a non-magnetic metal to avoid interfering with the operation of the motor 146.

Although the scroll device 100 is illustrated as utilizing a specific number of bolts 112 spaced at a specific angular interval, a specific number of bolts 120 also spaced at a specific angular interval, and a specific number of bolts 128 also spaced at a specific angular interval, embodiments of the present disclosure may comprise more or fewer bolts 112, 120, and/or 128, which may be spaced at greater or smaller angular intervals than the angular intervals illustrated in FIGS. 1A-1C. Additionally, in some embodiments, mechanical fasteners other than bolts may be used to secure the scroll plate 108 to the scroll housing 104, and/or to secure the motor housing 116 and the motor mount 192 to the scroll plate 108, and/or to the secure the endplate 124 to the motor housing 116. Also in some embodiments, adjacent ones of the scroll housing 104 (or a cylindrical portion 104A, 104B thereof), the scroll plate 108, the motor mount 196, the motor housing 116, and the endplate 124 may be integrally formed, or may be formed separately and then permanently attached to each other (via welding or otherwise).

FIG. 1C provides a side cross-sectional view of the scroll device 100. The scroll housing 104, scroll plate 108, bolts 112, motor mount 196, motor housing 116, bolts 120, endplate 124, and bolts 128 are all shown in FIG. 1C. Also visible in FIG. 1C are the apertures 132, 136, 176, and 180.

Inside the volume formed by the scroll housings 104 and the scroll plates 108 are two opposing scrolls 160 and 164, each comprising an involute 160A and 164A, respectively. Relative motion of the involutes 160A and 164A causes working fluid to be trapped within pockets formed between the two involutes 160A and 164A. These pockets continuously move the working fluid toward the center of the involutes 160A and 164A as the involutes 160A and 164A move relative to each other. The pockets also decrease in size, thus compressing the working fluid (for scroll devices that, like the scroll device 100, are scroll compressors). To prevent leakage of working fluid from inside these pockets, tip seals 172 are provided along the distal edge of each involute 160A and 164A. More specifically, a tip seal 172A is provided along the edge of the involute 160A that is proximate the scroll 164 (such that the tip seal 172A contacts the scroll 164), and another tip seal 172B is provided along the edge of the involute 164A that is proximate the scroll 160 (such that the tip seal 172B contacts the scroll 160).

The scroll 160 is secured to a cylindrical extension 162 that extends away from the scroll 164 and inside the motor housing 116 proximate the scroll 160. Similarly, the scroll 164 is secured to a cylindrical extension 166 that extends away from the scroll 160 and inside the motor housing 116 proximate the scroll 164. Each of the cylindrical extensions 162 and 166 is rotatably supported within one of the motor housings 116 by two bearings 152 and 156, one positioned proximate a first end of the cylindrical extensions 162 and 166 and another positioned proximate a second end opposite the first end of the cylindrical extensions 162 and 166. The cylindrical extensions 162 and 166 therefore support the scrolls 160 and 164, respectively, within the scroll housings 104.

Also within each motor housing 116 is an electric motor 146, comprising a stator 144 and a rotor 148. Each stator 144 is secured to the adjacent motor mount 196. Each rotor 148 comprises a plurality of permanent magnets, and is secured to one of the cylindrical extensions 162 and 166. The stator may comprise, for example, an electromagnet that, when energized, creates a magnetic field that interacts with the permanent magnets of the rotor 148 and causes the rotor 148 to spin. The cylindrical extensions 162 and 166 thus act as the shaft of the electric motors 146.

One or more sensors 118 is positioned between the scroll 160 and the scroll plate 108 adjacent thereto, as well as between the scroll 164 and scroll plate 108 adjacent thereto. The sensors 118 may be Hall effect sensors, optical sensors, magnetic sensors, or any other suitable sensors. The sensors 118 may be or comprise an encoder. Although illustrated herein as positioned between the scroll 160 and the scroll plate 108, in other embodiments, the sensors 118 may be positioned proximate the motor 146, or proximate the cylindrical extensions 162 and 166. The sensors 118 are used as feedback devices to sense the angular position and/or speed of the scrolls 160 and 164 (or of the motors 146, or of the cylindrical extensions 162 and 166), and to communicate information corresponding to the angular position and/or speed of the scrolls 160 and 164 to a controller 500, which is described in detail below in connection with FIG. 11.

During operation of the scroll device 100, uncompressed working fluid (for a scroll compressor) is received into the scroll housing 104 (and thus into the volume surrounding the scrolls 160 and 164) via the apertures 180 in the scroll plates 108. The working fluid is drawn into pockets that form between the involutes 160A and 164A, as described above, as the scrolls 160 and 164 move relative to each other. Compressed working fluid exits the pockets at or near the center volume 186 formed by the involutes 160A and 164A. The center volume 186 is in fluid communication with the internal volume 184 of the cylindrical extensions 162 and 166 (e.g., via one or more apertures in the scrolls 160 and 164), which internal volumes 184 are in fluid communication with the apertures 136 adjacent thereto, respectively. The apertures 136, then, are discharge ports to which hoses, pipes, or other conduits may be secured and utilized to route compressed working fluid to a desired location.

Throughout the scroll device 100, seals 174 are used to prevent leakage of working fluid through the joints between adjacent components of the scroll device 100. For example, a seal 174 is positioned between the motor mount 196 and the scroll plate 108, and another seal 174 is positioned proximate thereto, between the motor housing 116 and the motor mount 196. Similarly, a seal 174 is utilized between the motor housing 116 and the motor mount 196 proximate the endplate 124, and another seal 174 is positioned between the motor mount 196 and the endplate 124. Further, a seal 174 is positioned between the scroll housing 104 and each scroll plate 108. These and other seals 174 may be seated inside corresponding grooves or channels. The seals 174 may be dynamic O-rings, dynamic gaskets, radial lip seals, labrynth seals, bushings, or any other seals useful for preventing leakage of a fluid through a joint between two components. Further, the seals 174 may be made of compressed non-asbestos fiber, polytetrafluoroethylene (PTFE), rubber, other non-metallic materials, or any combination thereof; metal (whether a pure metal, a metal alloy, or a combination of metals or metal alloys); or a combination of non-metallic materials and metal. Some of the seals 174 may be made of one material or combination of materials, and others of the seals 174 may be made of a different material or combination of materials. Each seal 174 may be selected to provide a needed or desired level of impermeability, compressibility, creep resistance, resilience, chemical resistance, temperature resistance, anti-stick properties, and anti-corrosion properties. Because different scroll devices 100 may be used with different working fluids, the seals 174 may be selected based on the particular application intended for the scroll device 100 in which the seals 174 will be installed.

In some embodiments of the present disclosure, a scroll device such as the scroll device 100 may comprise an Oldham ring (positioned around the circumference of the involutes 160A, 164A of the scrolls 160 and 164) to help maintain proper phasing of the two scrolls 160, 164. In such embodiments, the Oldham ring may be provided as a failsafe (e.g., to ensure proper phasing even if the motors 146, as controlled by the controller 500, fail to do so). Regardless of whether the Oldham ring is utilized as a primary or backup phasing device, the Oldham ring may be made of aluminum or another relatively light metal or other lightweight but sufficiently strong material so as to minimize imbalance/vibration resulting from the Oldham ring. In some embodiments, inserts made of polyetheretherketone (PEEK), PTFE, Torlon®, or other wear-resistant plastics suitable for use as a lubricant may be used in portions of the the Oldham ring that contact the scrolls 160 and 164, whether as replaceable inserts or otherwise. Use of such inserts beneficially prevents wear on the remaining portions of the Oldham ring (which may be made, for example, of metal), and also allows for replacement of the inserts once they are sufficiently worn without having to replace the entire Oldham ring.

Additionally, the scroll device 100 may comprise an oil sump 168 in the bottom of the housing 104, in which oil sump 168 oil is provided for lubrication of the Oldham ring during operation of the scroll device 100.

While Oldham rings may be used in some embodiments of the present disclosure, other embodiments of the present disclosure do not utilize Oldham rings.

Also in some embodiments, and as noted above, the housing 104 may comprise one or more apertures extending entirely or partially around a circumference thereof (e.g., positioned in between the first cylindrical portion of the housing 104 and the second, offset cylindrical portion of the housing 104). A radial mesh filter may be positioned over or within the aperture(s). Inlet air or working fluid may then be drawn into the volume enclosed by the housing 104 and the scroll plates 108 (and then into the pockets formed by the involutes 160A and 164A) via the radial mesh filter and the aperture(s), with the radial mesh filter beneficially filtering out dust or other particles that would otherwise be ingested into the scroll device 100 together with the working fluid.

Figure 3:
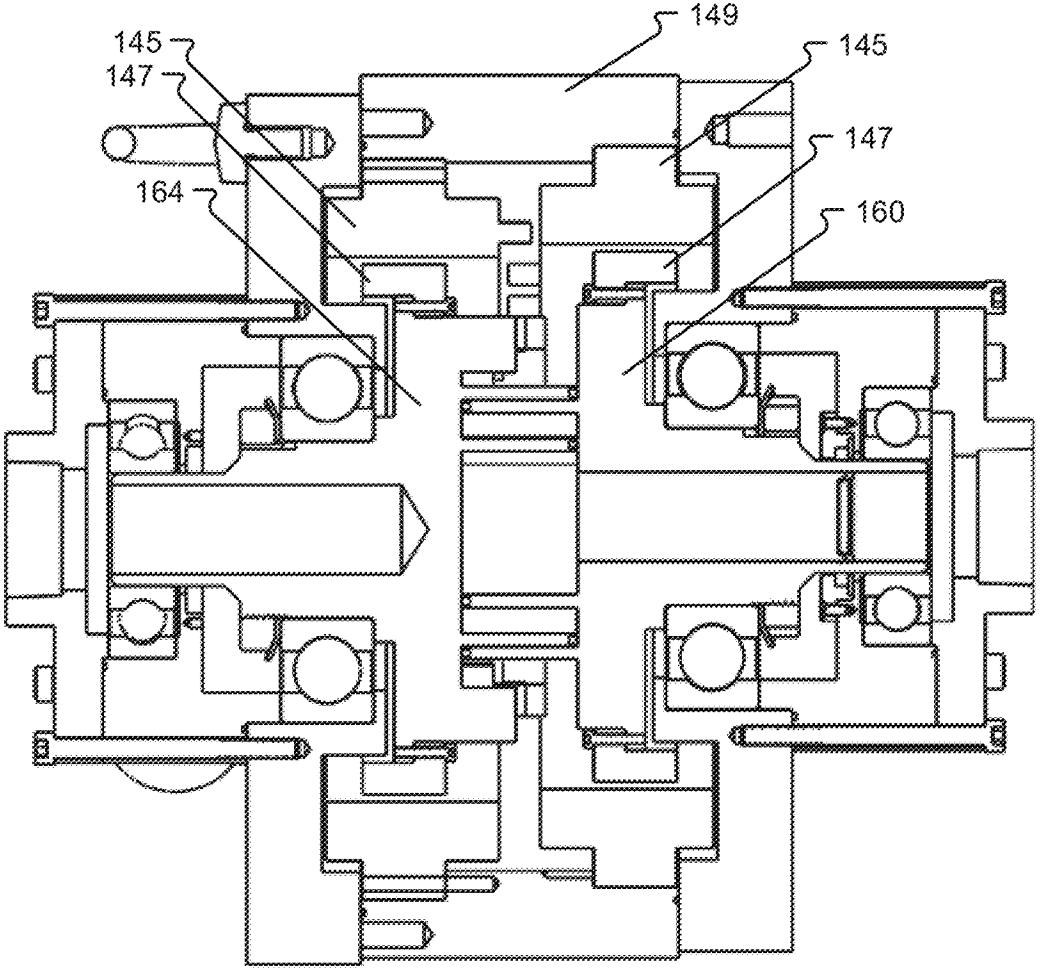
FIG. 3 is a side cross-sectional view of a scroll device according to at least some embodiments of the present disclosure.

In some embodiments, such as that illustrated in FIG. 3, permanent magnets 147 may be attached to the scrolls 160 and 164 (e.g., to or proximate the circumference of the scrolls 160 and 164), thus enabling the scrolls 160 and 164 to act as the rotor(s) of an electric motor 149. An electric motor stator 145 may then be placed to around the scrolls 160 and 164 (and the permanent magnets 147 attached thereto), thus creating a direct drive system for the scrolls 160 and 164.

In a variation of the foregoing embodiments, the permanent magnets may be attached to the scrolls 160 and 164 on a surface opposite the surface that comprises the involutes 160A and 164A, respectively. The stator may then be provided on a surface of the respective scroll plate 108 facing the surface of the scrolls 160 and 164 that comprise the permanent magnets, so as to provide an axial flux motor for causing rotation of the scrolls 160 and 164. Because the diameter of the central shaft (and thus of a working fluid output aperture within the central shaft) is limited in an axial flux motor, such motors are best used on low flow rate scroll devices.

Also in some embodiments, the motors 146 or a direct drive motor 149 as described above (and/or a controller of any of the foregoing) may use back emf to determine the angular position of the motor(s), after which the motor(s) may be driven at precisely the right voltage to maintain proper alignment between the scroll 160 and the scroll 164.

Figure 4:
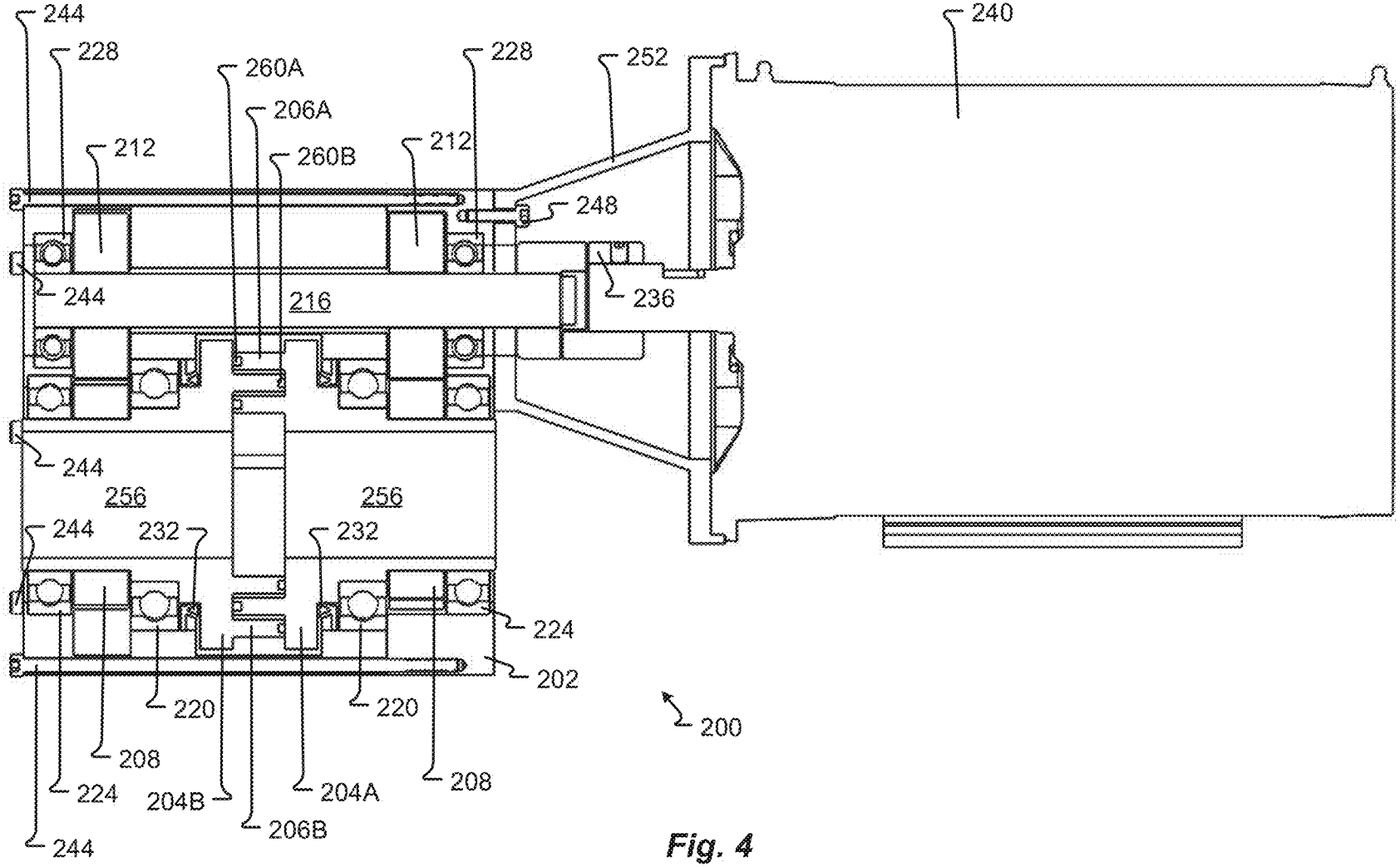
FIG. 4 is a side cross-sectional view of a co-rotating single motor scroll device with gear drive according to at least some embodiments of the present disclosure.

Turning now to FIG. 4, a scroll device 200 according to some embodiments of the present disclosure utilize a gear system to transmit rotational force from the motor to the scrolls. The scroll device 200 comprises a housing 202, within which two scrolls 204A, 204B are mounted on bearings 220, 224, thus enabling the scrolls 204A, 204B to rotate relative to the housing 202. Each scroll 220, 224 is fixedly secured to a drive gear 208, which extends around a circumference of the scroll 220, 224. A motor 240 is secured to the housing 202 via a housing extension 252. The motor 240 is connected to a drive shaft 216 via a jaw coupling 236. The drive shaft 216 is supported within the housing by two bearings 228. Two drive gears 212 are mounted to the drive shaft 216, with each drive gear 212 positioned to engage a corresponding drive gear 208. A plurality of fasteners 244, 248 are used to secure various components of the scroll device 200 in position. Additionally, dynamic seals 232 are utilized to reduce leakage of working fluid from the working fluid passageways formed by the scrolls 204A, 204B.

As with the scrolls 160, 164 of the scroll device 100, each scroll 204A, 204B of the scroll device 200 comprises an involute 206A, 206B, respectively. The motion of the involutes 206A, 206B relative to each other results in the formation of pockets in between the involutes 206A, 206B. Working fluid within these pockets is compressed as the size of the pocket is continuously decreased, again due to the motion of the involutes 206A, 206B relative to each other. Tip seals 260A, 260B on the involutes 206A, 206B, respectively, prevent working fluid from escaping the pockets through the joint between each involute 206A, 206B, and the opposite scroll 204B, 204A, respectively.

In operation, the motor 240 spins the drive shaft 216, thus causing the drive gears 212 to rotate. The drive gears 212 transmit torque to the drive gears 208, the rotation of which results in the rotation of the scrolls 204A, 204B to which they are affixed. Using the gears 208, 212 beneficially allows the motor 240 to be located away from the scrolls 204A, 204B, and facilitates the provision of large working fluid outlets 256. This, in turn, enables the scroll device 200 to be utilized in applications where a high flow rate is needed. Use of the drive shaft 216 and the gears 208, 212 beneficially enables the use of a single motor to drive both of the scrolls 204A, 204B, which may helpfully reduce cost and eliminate the need for complex sensor and/or controller systems used to ensure proper alignment of scrolls in a dual-motor system.

Additionally, the use of gears 208, 212 allows the scroll device 200 to benefit from mechanical advantage. More specifically, by adjusting the size of the gears 208 relative to the gears 212, mechanical advantage may be beneficially utilized to obtain the desired scroll rotation speed while allowing the motor 240 to operate at a different (perhaps more efficient) speed, and/or to enable a less-powerful (and likely cheaper) motor 240 to be used than would be required with a 1:1 drive ratio. Notwithstanding the foregoing, in some embodiments, the scroll device 200 may utilize a 1:1 drive ratio.

Except to the extent described or shown otherwise, the various components of the scroll device 200 may be the same as or similar to corresponding components of the scroll device 100. For example, the housing 202 may be made of any of the same materials as the housing 104, and the tip seals 260A, 260B may be the same as or similar to the tip seals 172A, 172B.

Figure 5:
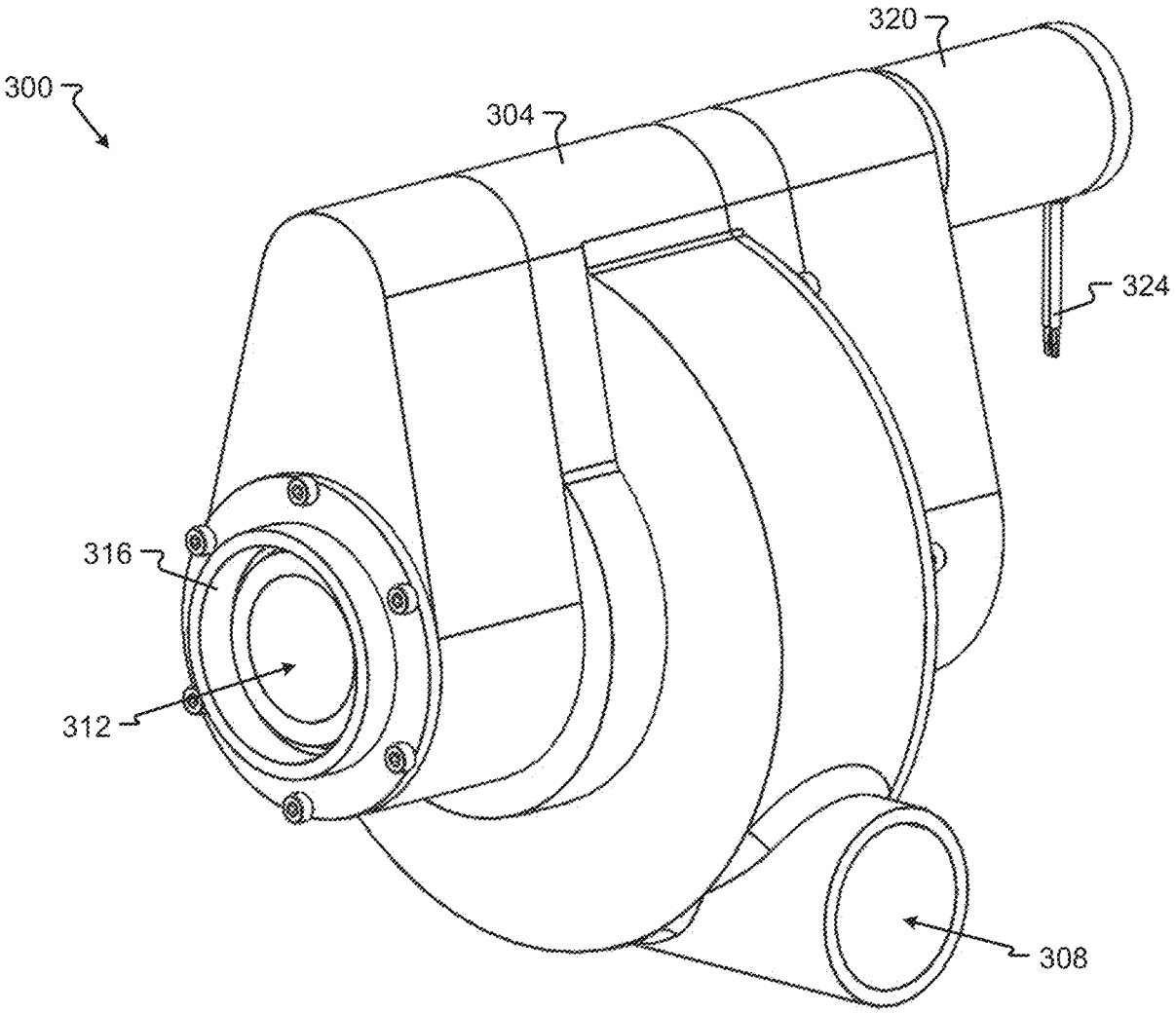
FIG. 5 is a perspective view of a co-rotating single motor scroll device with belt drive according to at least some embodiments of the present disclosure.
Figure 6:
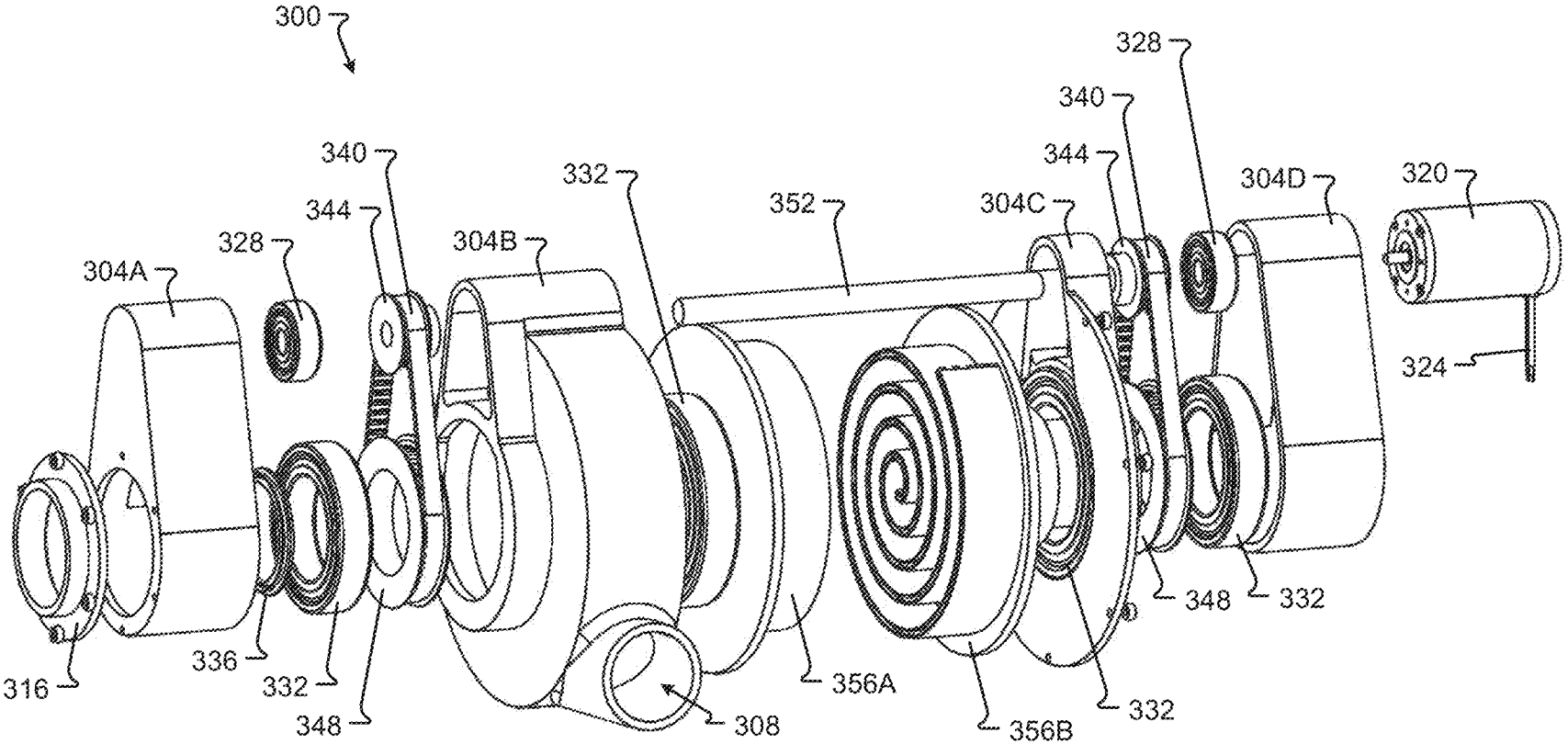
FIG. 6 is an exploded view of a co-rotating single motor scroll device with belt drive according to at least some embodiments of the present disclosure.
Figure 7:
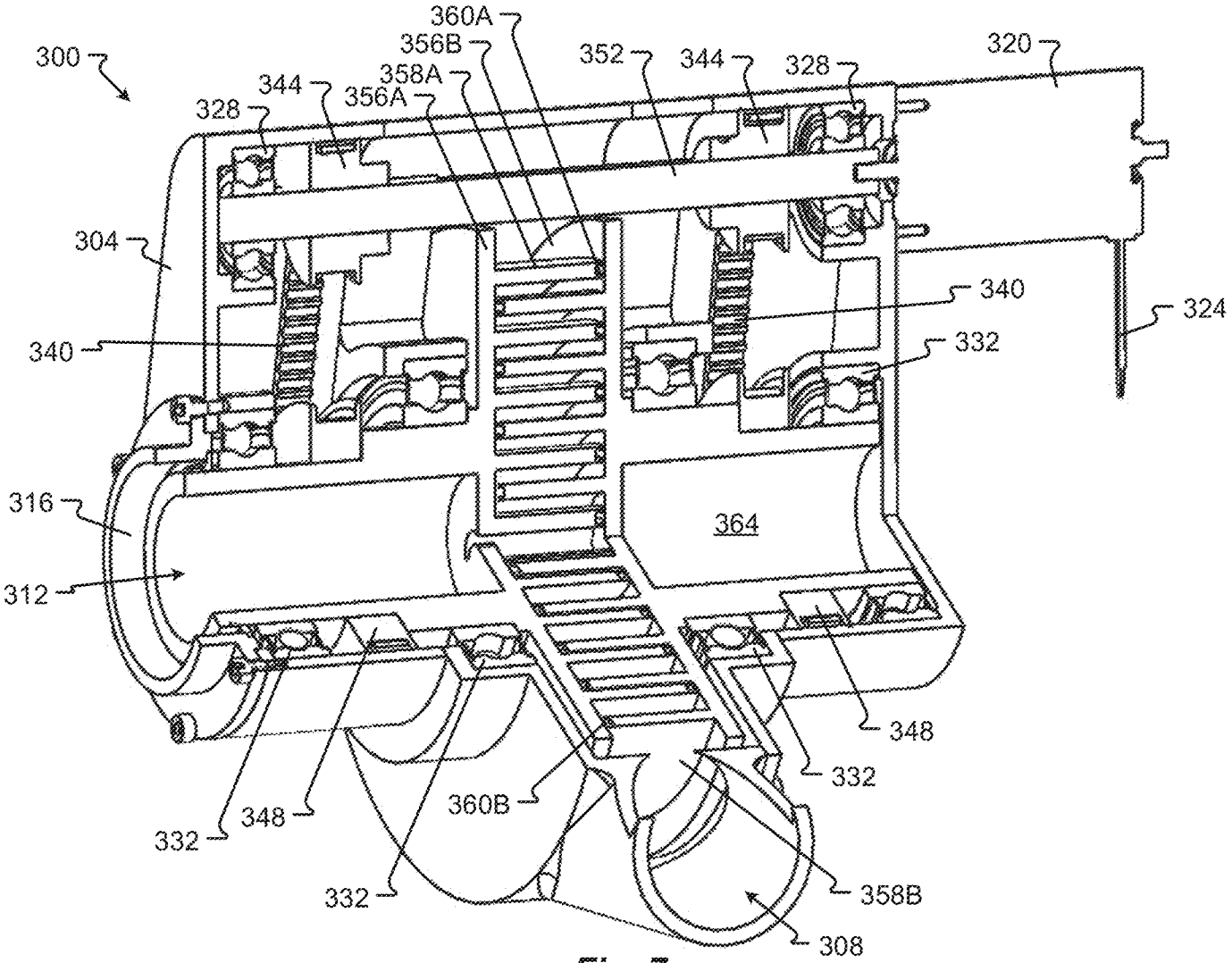
FIG. 7 is a cross-sectional view of a co-rotating single motor scroll device with belt drive according to at least some embodiments of the present disclosure.

Turning now to FIGS. 5-7, a dual-drive co-rotating scroll device 300 comprises a housing 304, a working fluid inlet 308, a working fluid outlet 312, and a coupling 316. The housing 304 comprises a first portion 304A, a second portion 304B, a third portion 304C, and a fourth portion 304D. The coupling 316 may be integral with the housing 304 (or more specifically with the housing portion 304A), or the coupling 316 may be manufactured separately from the housing 304 and then secured to the housing 304 with one or more fasteners, as shown. A motor 320 is also secured to the housing 304, and is operably connected to a drive shaft 352 within the housing. One or more wires 324 for powering and/or controlling the motor 320 may extend from the motor 320 to a power source and/or controller (not shown).

Within the scroll device 300, two scrolls 356A, 356B are each supported by a plurality of bearings 332. Each scroll 356A, 356B comprises an involute 358A, 358B, respectively. Each involute 358A, 358B further comprises a tip seal 360A, 360B, with the tip seal 360A of the involute 358A positioned in between the involute 358A and the scroll 356B, and the tip seal 360B of the involute 358B positioned in between the involute 358B and the scroll 356A.

A main pulley 348 is secured around a circumference of the scroll 358A, with another main pulley 348 secured around a circumference of the scroll 358B. Secondary pulleys 344 are secured to the drive shaft 352 at positions aligned with the positions of the main pulleys 348. A belt 340 connects the main pulley 348 and the secondary pulley 344, providing force-transmitting communication therebetween. A plurality of bearings 328 rotatably support the drive shaft 352 within the housing 304.

One or more dynamic seals 336 may be used within the scroll device 300 to help prevent leakage of the working fluid from the within the working fluid passages inside the scroll device 300. Additionally, various fasteners may be used to secure components of the scroll device 300 in position.

In operation, the motor 320 causes the drive shaft 352 to rotate, together with the pulleys 344 affixed thereto. As the pulleys 344 rotate, the belts 340 transfer torque to the pulleys 348, which in turn cause the scrolls 356A, 356B to which they are affixed to rotate. As the scrolls rotate, the relative movement of the involutes 358A, 358B thereof results in compression of the working fluid, which is drawn into the scroll device 300 via the inlet 308 and discharged via the outlet 312. A hose, pipe, or other conduit may be fixedly or removably secured to the coupling 316 for routing the working fluid from the scroll device 300 to a desired location.

Where the working fluid is an incompressible fluid, such that there is a 1:1 ratio between the inlet volume and the outlet volume, the inlet 308 and the outlet 312 may be reversed. Additionally, the scroll device 300 could be modified to utilize two inlets and/or two outlets to reduce throttling effects and increase flow rate. For example, an additional aperture could be provided in the housing 304 (and more specifically, in the housing portion 304D) adjacent the volume 364, thus enabling the volume 364 to serve as a second outlet (or, if the outlet 312 and inlet 308 are reversed, as a second inlet).

As with the use of gears 208, 212 in the scroll device 200, the use of pulleys 344, 348 in the scroll device 300 allows the scroll device 300 to benefit from mechanical advantage. More specifically, by adjusting the size of the pulleys 344 relative to the pulleys 348, mechanical advantage may be beneficially utilized to obtain the desired scroll rotation speed while allowing the motor 320 to operate at a different (perhaps more efficient) speed, and/or to enable a less-powerful (and likely cheaper) motor 320 to be used than would be required with a 1:1 drive ratio. Notwithstanding the foregoing, in some embodiments, the scroll device 300 may utilize a 1:1 drive ratio.

In both the scroll device 200 and the scroll device 300, the drive shafts 216 and 352, respectively, must remain equidistant from the center of rotation of each scroll of the scroll device to maintain an equal rotation speed and thus the needed relative angular position between the scrolls. In some embodiments, the drive shafts 216 and 352 may comprise the rotor of the motors 240 and/or 320, respectively, in which event the stator and other portions of the motor may be centrally mounted positioned around the drive shaft, in between the gears or pulleys that are also mounted to the drive shaft.

Use of a drive shaft and gears or pulleys to transmit power from the motor to the dual co-rotating scrolls of a scroll device such as the scroll devices 200 and 300 may beneficially reduce cost by reducing the number of required motors from two (e.g., in dual drive co-rotating scroll devices where each scroll is driven by a separate motor) to one. On the other hand, embodiments that use two motors (and an Oldham ring to maintain alignment between the scrolls) may be more robust, as the scroll device can continue to operate despite the failure of one motor.

Any of the motors described herein may utilize liquid cooling to remove heat therefrom. The liquid coolant may be routed around the motor in channels provided in the motor housing (or in any housing in which the motor is mounted) for that purpose, or the liquid coolant may be routed around the motor via tubing, hoses, or any other suitable conduit.

Figure 8:
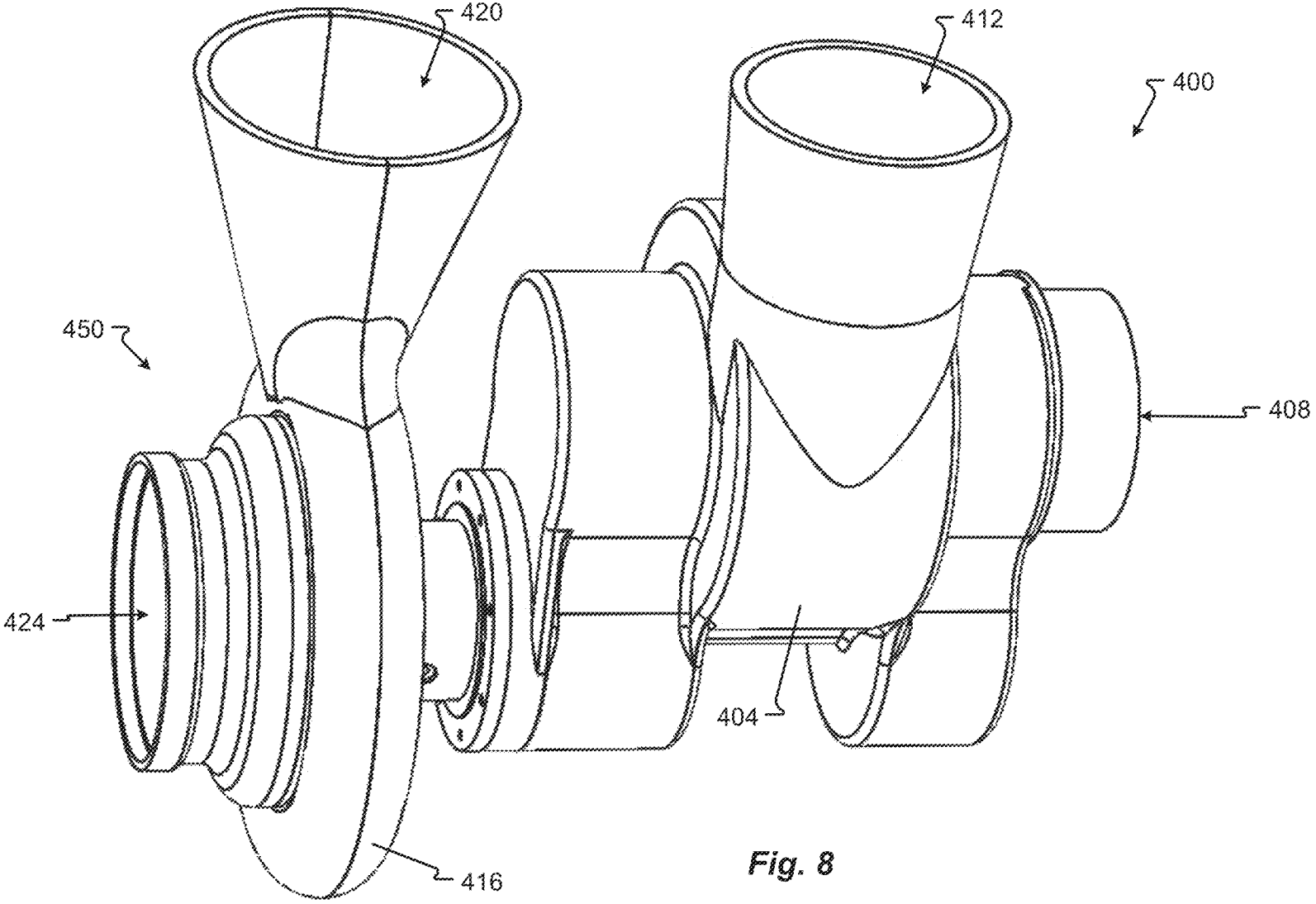
FIG. 8 is a perspective view of a turbine-driven spinning scroll device according to at least some embodiments of the present disclosure.
Figure 9:
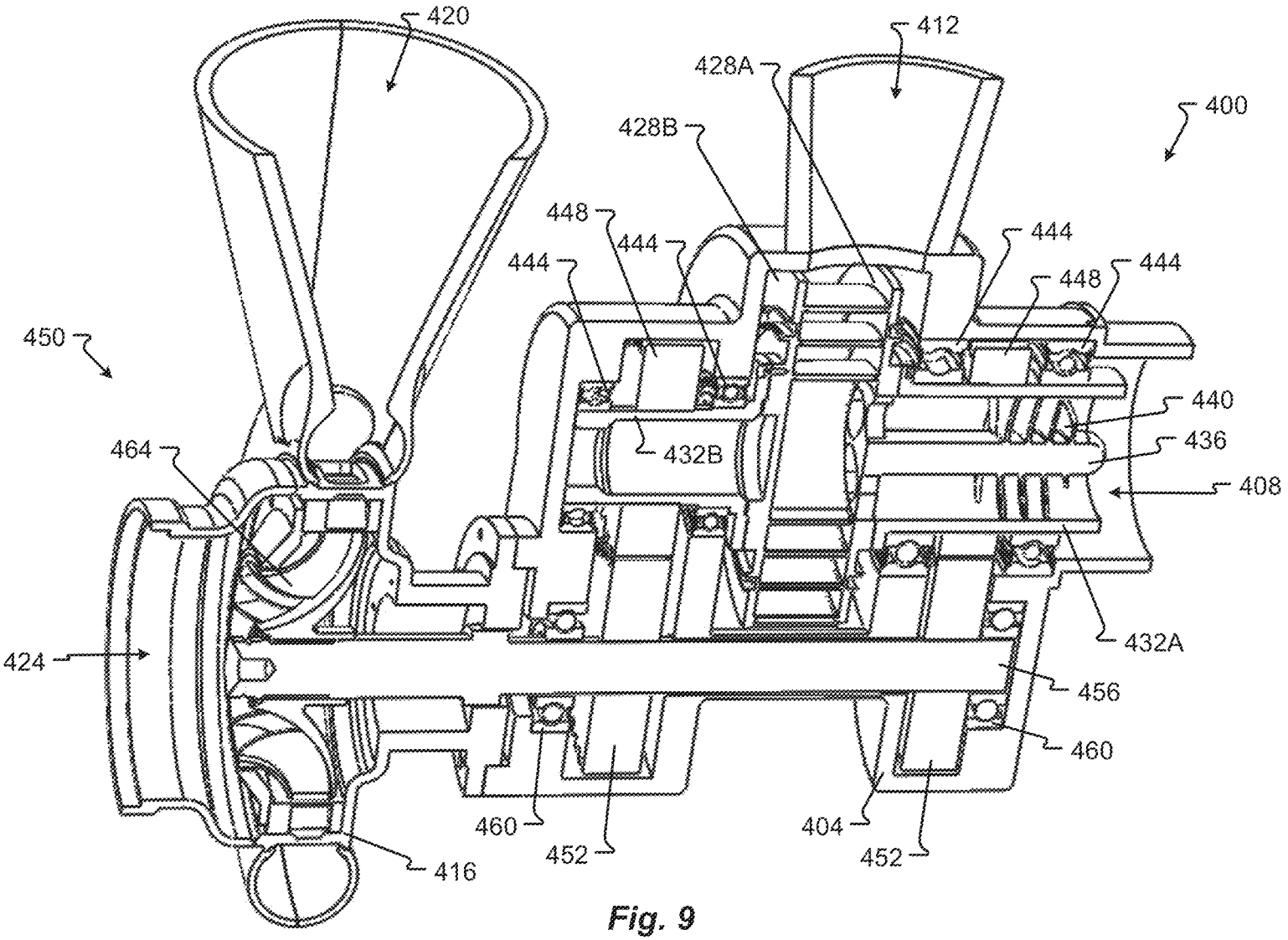
FIG. 9 is a perspective cross-sectional view of a turbine-driven spinning scroll device according to at least some embodiments of the present disclosure.
Figure 10:
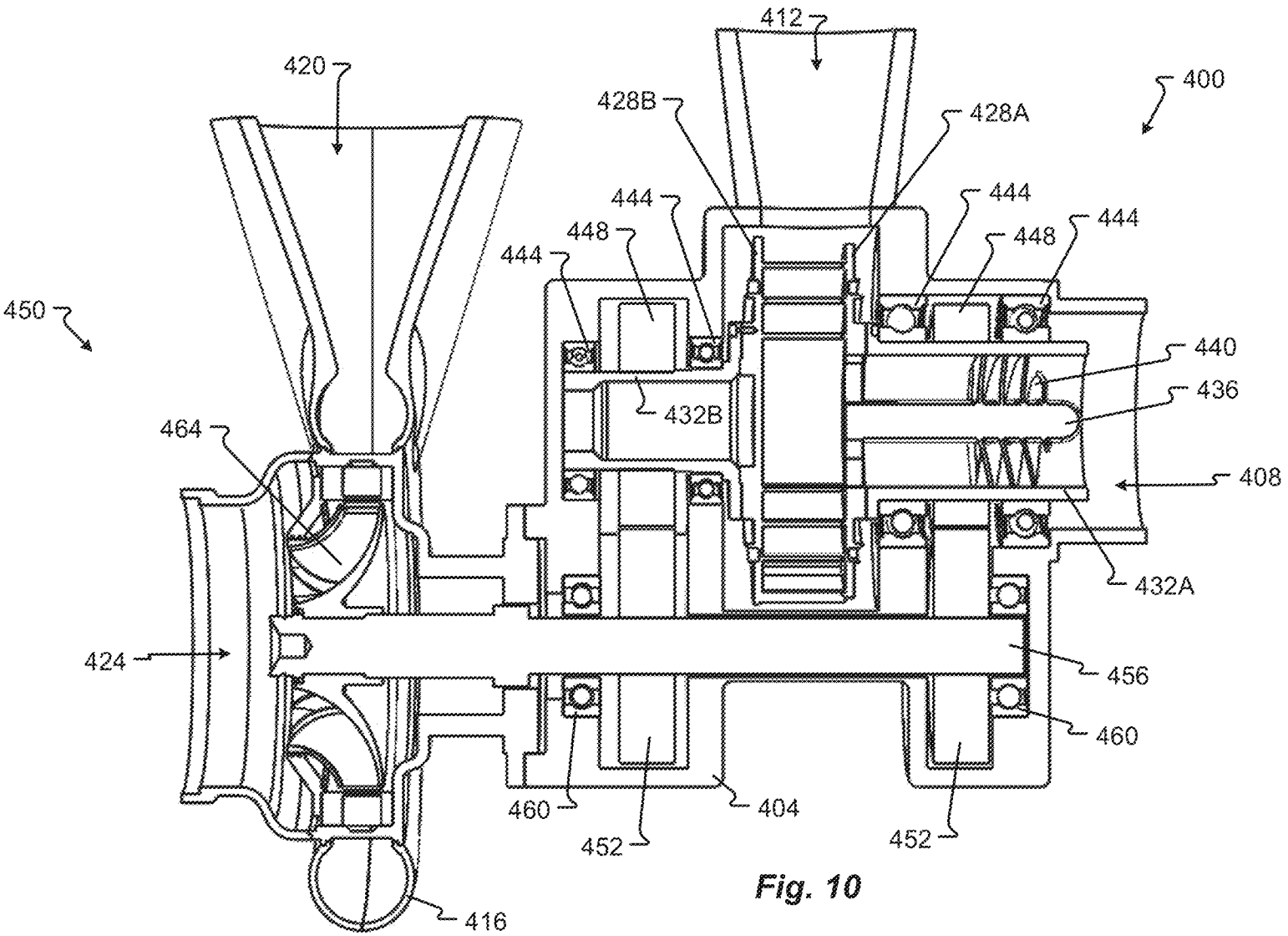
FIG. 10 is a side cross-sectional view of a turbine-driven spinning scroll device according to at least some embodiments of the present disclosure.

Turning now to FIGS. 8-10, the present disclosure further comprises a cryogenic scroll turbopump 400 driven by a turbine 450, which may utilize a dual gear drive. The scroll turbopump 400 comprises a housing 404, an inlet 408, and an outlet 412. The turbine 450 comprises a turbine housing 416, a turbine inlet 420, and a turbine outlet 424.

Two scrolls 428A and 428B (each secured to a scroll extension 432A, 432B, respectively) are rotatably mounted within the housing 404, each via its respective scroll extension 432A, 432B and a plurality of bearings 444. The scroll extension 432A may be integral with the scroll 428A, or may be fixedly or removably secured to the scroll 428A. In some embodiments, the scroll extension 432A may be welded to the scroll 428A, while in other embodiments the scroll extension 432A may be secured to the scroll 428A via a plurality of mechanical fasteners. The second scroll extension 432B may also be integral with the scroll 428B, or may be fixedly or removably secured to the scroll 428B. In some embodiments, the scroll extension 432B may be welded to the scroll 428B, while in other embodiments the scroll extension 432B may be secured to the scroll 428B via a plurality of mechanical fasteners. One or more gaskets or seals (including, for example, dynamic seals) may be used to prevent leakage of working fluid through joints between components of the scroll turbopump 400 (and/or between components of the turbine 450).

An inducer rotor 440 is mounted to an inducer shaft 436 that extends through the pump inlet 408, with the inducer shaft 436 coaxial with the scroll 428A. The inducer rotor 440 raises the inlet pressure of the working fluid to reduce the pressure differential between the inlet and outlet pressures of the scroll turbopump 400, which beneficially reduces the amount of cavitation likely to occur as the working fluid passes through the scrolls 428A, 428B.

Fixedly mounted to each scroll extension 432A, 432B is a gear 448, each of which gears 448 is aligned and in contact with a corresponding gear 452 fixedly mounted on the drive shaft 456. The drive shaft 456 is rotatably mounted within the housing 404 via a plurality of bearings 460. The drive shaft 456 extends beyond the housing 404 and into the turbine 450, where the turbine blades 464 are mounted to the drive shaft 456.

In operation, high pressure fluid enters the turbine inlet 420 and pushes against the turbine blades 464 as it passes therethrough before exiting the turbine outlet 424. The force of the fluid against the turbine blades 464 causes those blades 464, as well as the shaft 456 to which they are mounted, to rotate at high angular velocity. As the shaft 456 rotates, the gears 452 mounted thereto also rotate. Because the gears 452 are in force-transmitting communication with the gears 448, the gears 448 also rotate, thus causing rotation of the scrolls 428A, 428B and of the impeller shaft 436 and impeller rotor 440. This causes working fluid to be drawn into the scroll turbopump 400 via the inlet 408, and discharged from the scroll turbopump 400 via the outlet 412. The inducer rotor 440 operates to provide an initial pressure increase to the working fluid, so as to reduce cavitation as the working fluid enters the volume between the scrolls 428A, 428B and undergoes a more significant pressure increase.

Figure 11:
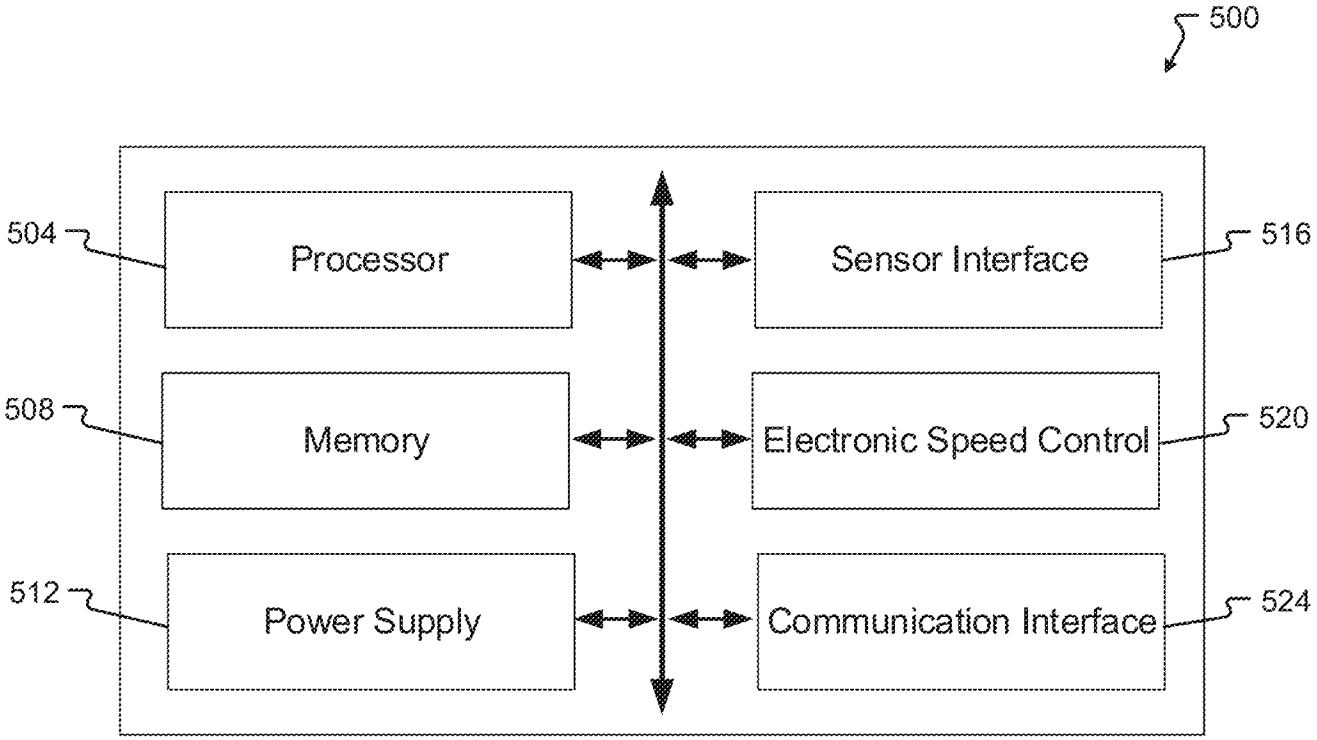
FIG. 11 is a block diagram of a controller according to at least some embodiments of the present disclosure.

With reference to FIG. 11, a controller 500 according to embodiments of the present disclosure is used control one or more of the scroll devices described herein. The controller 500 may comprise a processor 504 configured to receive data from or via one or more of the memory 508, the sensor interface 516, the electronic speed control 520, and/or the communication interface 524. The processor 504 may also be configured to execute instructions stored in the memory 508, and to generate one or more control signals for transmission via the communication interface 524.

The processor 504 may be or be selected from among the following processors and processor families: Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22nm Haswell, Intel® Core® i5-3570K 22nm Ivy Bridge, the AMD® FX™ family of processors, AMD® FX-4300, FX-6300, and FX-8350 32nm Vishera, AMD® Kaveri processors, Texas Instruments® Jacinto C6000™ automotive infotainment processors, Texas Instruments® OMAP™ automotive-grade mobile processors, ARM® Cortex™-M processors, and ARM® Cortex-A and ARM926EJ-S™ processors. A processor as disclosed herein may perform computational functions using any known or future-developed standard, instruction set, libraries, and/or architecture.

The memory 508 may be any computer-readable memory capable of storing data for retrieval by the processor 508. The data may comprise, for example, instructions for operation of any of the scroll devices 100, 200, 300, or 400 described herein, or any similar scroll device, and more particularly for operation of the electrical components of any such scroll device; instructions for receiving sensor information from sensors such as the sensors 118, for evaluating such sensor information, and for generating one or more control signals based on such sensor information; for receiving and sending communications via the communication interface 524; for operating the electronic speed control 520, whether based on information stored in the memory 508, information received via the sensor interface 516, information received via the communication interface 524, or any combination of the foregoing; and instructions for controlling the power supply 512 to turn on, turn off, or limit the flow of electricity to a motor or other electronic component of a scroll device according to embodiments of the present diclosure.

The power supply 512 may be controllable by the processor 504 and may control the flow of electricity to a motor or other electronic component of a scroll device according to embodiments of the present disclosure. The power supply 512 may also act as a power conditioner, so as to ensure that electricity is provided to the scroll device at the appropriate voltage level regardless of load. The power supply 512 may, for example, operate to prevent voltage spikes from being passed on to the scroll device to which the controller 500 is connected.

The sensor interface 516 may comprise a physical and/or electrical interface for receiving (whether directly or via the communication interface 524) signals from one or more sensors such as the sensors 118 within a scroll device to which the controller 500 is connected. The sensor interface 516 may convert any such signals into a format that may be processed by the processor 504, and/or may generate one or more signals for transmission to the processor 504 based on received sensor information. In some embodiments, the sensor interface 516 is configured for bi-directional communications with one or more sensors (e.g., when one or more sensors connected thereto are electronically controllable or configurable), while in other embodiments the sensor interface 516 is only configured to receive signals from the sensors, and not to transmit signals to the sensors.

The electronic speed control 520, which may be controlled by the processor 504, controls the speed of the motor or motors of the scroll device to which the controller 500 is connected. For controllers 500 controlling dual-motor devices, the electronic speed control 520 may be used to ensure that each motor is operating at the appropriate speed to ensure that the scrolls of the scroll device maintain an appropriate angular position relative to each other. Also in such embodiments, the controller 500 may comprise a separate electronic speed control 520 for each motor. For controllers 500 controlling single-motor devices, the electronic speed control 520 may be used to maintain a motor speed that yields the greatest efficiency, or that provides the desired flow rate of working fluid through the scroll device.

The communication interface 524 may be a wired or wireless communication interface, and may comprise hardware (including, for example, physical ports) and/or software. The communication interface 524 may be configured to receive signals from a connected scroll device and/or any component thereof, and to route those signals to the processor 504, the memory 508, the sensor interface 516, or any other component of the controller 500 to which the signals are directed. In some embodiments, the communication interface 524 may be configured to route incoming signals without any modification of the same, while in other embodiments the communication interface may be configured to convert incoming signals from one format to another, so that the signals can be read by the appropriate component of the controller 500.

The communication interface 524 may also be configured to transmit signals generated by or otherwise originating within the controller 500 or a component thereof. For example, in some embodiments motor control signals generated by the processor 504 and/or by the electronic speed control 520 may be routed to the communication interface 524 for transmission to the motor of an attached scroll device.

In some embodiments, the communication interface 524 may also be configured to send and receive signals via a local area network, a wide area network, the cloud, a server or computer, or any other device or network. In such embodiments, the communication interface 524 may enable the controller 500 to be remotely controlled and/or configured. Also in such embodiments, the communication interface 524 may enable the controller 500 to transmit operating information about the controller 500 and/or a connected scroll device to another device, where the operating information can be analyzed or otherwise beneficially utilized. The communication interface 524 may be configured to communicate using any known protocol or protocols, including, for example, Wi-Fi, ZigBee, Bluetooth, Bluetooth low energy (BLE), TCP/IP, WiMax, CDMA, GSM, LTE, FM, and/or AM. Thus, the communication interface 524 may comprise one or more radios, one or more antennas, and other components necessary for communications using these or other known protocols.

The present disclosure encompasses a spinning scroll device utilizing an Oldham ring for phasing.

The present disclosure encompasses a spinning scroll device utilizing two motors to maintain phasing of two spinning involutes.

The present disclosure encompasses a spinning scroll device utilizing an oil sump at the bottom of the housing for lubrication of an Oldham ring during operation.

The present disclosure encompasses a spinning scroll device with variable eccentric holes integrated into the housing to change the radial clearances.

The present disclosure encompasses a spinning scroll device utilizing the same housing for both spinning scrolls within the device.

The present disclosure encompasses a spinning scroll device utilizing a mechanical face seal to separate outlet pressure from inlet pressure.

The present disclosure encompasses a spinning scroll device utilizing liquid cooling to remove heat from the motors.

The present disclosure encompasses a spinning scroll device with a housing that comprises a radial filter to prevent dust ingestion.

Embodiments of the present disclosure include a scroll device comprising: a housing; a first scroll rotatably mounted within the housing via a first cylindrical extension and a first plurality of bearings, the first scroll having a first axis of rotation; a second scroll rotatably mounted within the housing via a second cylindrical extension and a second plurality of bearings, the second scroll having a second axis of rotation different than the first axis of rotation; wherein at least one of the first cylindrical extension and the second cylindrical extension comprises a plurality of permanent magnets and operates as a rotor of a first motor; and an Oldham ring positioned between the first scroll and the second scroll and configured to maintain a relative angular position between the first scroll and the second scroll.

Aspects of the foregoing scroll device include: wherein the first motor is operably connected to the first scroll and a second motor is operably connected to the second scroll; a controller for controlling an operating speed of the first motor and of the second motor; wherein the first plurality of bearings comprises a first bearing positioned proximate a first end of the first cylindrical extension and a second bearing positioned proximate an opposite end of the first cylindrical extension; wherein the housing comprises a scroll housing, a scroll plate secured to the scroll housing, a motor housing secured to the scroll plate, and an endplate secured to the motor housing; wherein the scroll housing comprises a first cylindrical portion and a second cylindrical portion, the first and second cylindrical portions having offset axes; wherein the scroll plate comprising a working fluid inlet and the endplate comprises a working fluid outlet; an oil sump for lubricating the Oldham ring; wherein the Oldham ring comprises a metallic portion and a non-metallic portion; and wherein the non-metallic portion is replaceable.

Embodiments of the present disclosure also include a co-rotating scroll device comprising: a housing; a first scroll rotatably mounted within the housing and having a first axis of rotation; a second scroll rotatably mounted within the housing and having a second axis of rotation offset from the first axis of rotation; a motor; and a drive shaft having a third axis of rotation equidistant from the first axis of rotation and the second axis of rotation, the drive shaft configured to transmit torque from the motor to each of the first scroll and the second scroll.

Aspects of the foregoing scroll device include: wherein the drive shaft transmits torque to each of the first scroll and the second scroll via a plurality of gears; wherein the drive shaft transmits torque to each of the first scroll and the second scroll via a plurality of belts and pulleys; wherein when the motor operates at a first rotational speed, the first scroll and the second scroll are configured to rotate at a second rotational speed different than the first rotational speed; wherein the motor is liquid cooled; and wherein the motor is connected to the drive shaft via a jaw coupling.

Embodiments of the present disclosure further include a scroll turbopump comprising: a housing defining a working fluid inlet and a working fluid outlet; a first scroll rotatably mounted within the housing; a first scroll extension mounted to the first scroll and extending from the first scroll into the working fluid inlet; an inducer shaft extending from the first scroll into the first scroll extension, the inducer shaft coaxial within the first scroll; an inducer rotor mounted to the inducer shaft within the first scroll extension; a second scroll rotatably mounted within the housing; a second scroll extension mounted to the second scroll; a set of first gears, each one of the set of first gears mounted to one of the first and second scroll extensions; a set of second gears, each one of the set of second gears mounted to a drive shaft having an axis of rotation equidistant from an axis of rotation of the first scroll and the second scroll; and a turbine operably connected to the drive shaft.

Aspects of the foregoing scroll turbopump include: wherein the turbine comprises turbine blades secured to the drive shaft; wherein when the drive shaft rotates at a first speed, the first scroll and second scroll rotate at a second speed different than the first speed; and wherein the drive shaft is rotatably mounted within the housing by a plurality of bearings.

The terms "memory" and "computer-readable memory" are used interchangeably and, as used herein, refer to any tangible storage and/or transmission medium that participate in providing instructions to a processor for execution. Such a medium may take many forms, including but not limited to, non-volatile media, volatile media, and transmission media. Non-volatile media includes, for example, NVRAM, or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, a CD-ROM, any other optical medium, punch cards, paper tape, any other physical medium with patterns of holes, a RAM, a PROM, and EPROM, a FLASH-EPROM, a solid state medium like a memory card, any other memory chip or cartridge, a carrier wave as described hereinafter, or any other medium from which a computer can read. A digital file attachment to e-mail or other self-contained information archive or set of archives is considered a distribution medium equivalent to a tangible storage medium. When the computer-readable medium is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored.

Ranges may have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

a housing comprising a scroll housing, a scroll plate secured to the scroll housing, a motor housing secured to the scroll plate, and an endplate secured to the motor housing;

a first pair of dowel pin receptacles arranged at a first radial position on a mating surface of the scroll housing, the first pair of dowel pin receptacles comprising:

a first dowel pin receptacle disposed on a first radial side of the scroll housing; and a second dowel pin receptacle disposed on a second radial side of the scroll housing, wherein a line extending between the first dowel pin receptacle and the second dowel pin receptacle passes through an axis of the scroll housing, and wherein a dimension from the first dowel pin receptacle to the axis of the scroll housing is set at a first distance; and a second pair of dowel pin receptacles arranged at a second radial position on the mating surface of the scroll housing, the second pair of dowel pin receptacles comprising:

a third dowel pin receptacle disposed on the first radial side of the scroll housing; and a fourth dowel pin receptacle disposed on the second radial side of the scroll housing, wherein a dimension from the third dowel pin receptacle to the axis of the scroll housing is set at a second distance that is different from the first distance, wherein the scroll plate is configured to mount to the scroll housing via locating dowel pins engaged with the scroll plate and with the first pair of dowel pin receptacles or the second pair of dowel pin receptacles, wherein a first position of the scroll plate relative to the scroll housing is set when the locating dowel pins are engaged with the first pair of dowel pin receptacles, and wherein a second position of the scroll plate relative to the scroll housing is set when the locating dowel pins are engaged with the second pair of dowel pin receptacles;

a first scroll rotatably mounted within the scroll housing via a first cylindrical extension and a first plurality of bearings, the first scroll having a first axis of rotation;

a second scroll rotatably mounted within the scroll housing via a second cylindrical extension and a second plurality of bearings, the second scroll having a second axis of rotation different than the first axis of rotation;

a first motor operably connected to the first scroll; and a second motor operably connected to the second scroll.

2. The scroll device of claim 1, wherein at least one of the first cylindrical extension and the second cylindrical extension comprises a plurality of permanent magnets and operates as a rotor of at least one of the first motor or the second motor.

3. The scroll device of claim 1, further comprising an Oldham ring positioned between the first scroll and the second scroll and configured to maintain a relative angular position between the first scroll and the second scroll.

4. The scroll device of claim 1, wherein the first plurality of bearings comprises a first bearing positioned proximate a first end of the first cylindrical extension and a second bearing positioned proximate an opposite end of the first cylindrical extension.

5. The scroll device of claim 1, wherein the scroll plate is secured to the scroll housing via a set of alternating fasteners and a plurality of the locating dowel pins.

6. The scroll device of claim 5, wherein the set of alternating fasteners comprises bolts.

7. A scroll device comprising:

a housing comprising a scroll housing, a scroll plate secured to the scroll housing, a motor housing secured to the scroll plate, and an endplate secured to the motor housing;

a first pair of dowel pin receptacles arranged at a first radial position on a mating surface of the scroll housing, the first pair of dowel pin receptacles comprising:

a first dowel pin receptacle disposed on a first radial side of the scroll housing; and a second dowel pin receptacle disposed on a second radial side of the scroll housing, wherein a line extending between the first dowel pin receptacle and the second dowel pin receptacle passes through an axis of the scroll housing, and wherein a dimension from the first dowel pin receptacle to the axis of the scroll housing is set at a first distance; and a second pair of dowel pin receptacles arranged at a second radial position on the mating surface of the scroll housing, the second pair of dowel pin receptacles comprising:

a third dowel pin receptacle disposed on the first radial side of the scroll housing; and a fourth dowel pin receptacle disposed on the second radial side of the scroll housing, wherein a dimension from the third dowel pin receptacle to the axis of the scroll housing is set at a second distance that is different from the first distance, wherein the scroll plate is configured to mount to the scroll housing via locating dowel pins engaged with the scroll plate and with the first pair of dowel pin receptacles or the second pair of dowel pin receptacles, wherein a first position of the scroll plate relative to the scroll housing is set when the locating dowel pins are engaged with the first pair of dowel pin receptacles, and wherein a second position of the scroll plate relative to the scroll housing is set when the locating dowel pins are engaged with the second pair of dowel pin receptacles;

a first scroll rotatably mounted within the scroll housing via a first cylindrical extension and a first plurality of bearings, the first scroll having a first axis of rotation;

a second scroll rotatably mounted within the scroll housing via a second cylindrical extension and a second plurality of bearings, the second scroll having a second axis of rotation different than the first axis of rotation;

a first motor operably connected to the first scroll; and a second motor operably connected to the second scroll, wherein at least one of the first cylindrical extension and the second cylindrical extension comprises a plurality of permanent magnets and operates as a rotor of at least one of the first motor or the second motor; and an Oldham ring positioned between the first scroll and the second scroll and configured to maintain a relative angular position between the first scroll and the second scroll.

8. A scroll device comprising:

a housing comprising a scroll housing, a scroll plate secured to the scroll housing, a motor housing secured to the scroll plate, and an endplate secured to the motor housing;

a first pair of dowel pin receptacles arranged at a first radial position on a mating surface of the scroll housing, the first pair of dowel pin receptacles comprising:

a first dowel pin receptacle disposed on a first radial side of the scroll housing; and a second dowel pin receptacle disposed on a second radial side of the scroll housing, wherein a line extending between the first dowel pin receptacle and the second dowel pin receptacle passes through an axis of the scroll housing, and wherein a dimension from the first dowel pin receptacle to the axis of the scroll housing is set at a first distance;

a second pair of dowel pin receptacles arranged at a second radial position on the mating surface of the scroll housing, the second pair of dowel pin receptacles comprising:

a third dowel pin receptacle disposed on the first radial side of the scroll housing; and a fourth dowel pin receptacle disposed on the second radial side of the scroll housing, wherein a dimension from the third dowel pin receptacle to the axis of the scroll housing is set at a second distance that is different from the first distance, wherein the scroll plate is configured to mount to the scroll housing via locating dowel pins engaged with the scroll plate and with the first pair of dowel pin receptacles or the second pair of dowel pin receptacles, wherein a first position of the scroll plate relative to the scroll housing is set when the locating dowel pins are engaged with the first pair of dowel pin receptacles, and wherein a second position of the scroll plate relative to the scroll housing is set when the locating dowel pins are engaged with the second pair of dowel pin receptacles;

a first scroll rotatably mounted within the scroll housing via a first cylindrical extension and a first plurality of bearings, the first scroll having a first axis of rotation;

a second scroll rotatably mounted within the scroll housing via a second cylindrical extension and a second plurality of bearings, the second scroll having a second axis of rotation different than the first axis of rotation;

wherein at least one of the first cylindrical extension and the second cylindrical extension comprises a plurality of permanent magnets and operates as a rotor of a first motor; and an Oldham ring positioned between the first scroll and the second scroll and configured to maintain a relative angular position between the first scroll and the second scroll.

9. The scroll device of claim 8, wherein the first plurality of bearings comprises a first bearing positioned proximate a first end of the first cylindrical extension and a second bearing positioned proximate an opposite end of the first cylindrical extension.

10. The scroll device of claim 8, wherein the scroll housing comprises a first cylindrical portion and a second cylindrical portion, the first and second cylindrical portions having offset axes.

11. The scroll device of claim 8, wherein the scroll plate comprising a working fluid inlet and the endplate comprises a working fluid outlet.

12. The scroll device of claim 8, further comprising an oil sump for lubricating the Oldham ring.

13. The scroll device of claim 8, wherein the Oldham ring comprises a metallic portion and a non-metallic portion.

14. The scroll device of claim 13, wherein the non-metallic portion is replaceable.

15. The scroll device of claim 8, wherein the scroll plate is secured to the scroll housing via a set of alternating fasteners and a plurality of the locating dowel pins.

16. The scroll device of claim 15, wherein the set of alternating fasteners comprises bolts.

17. The scroll device of claim 8, wherein the first motor is operably connected to the first scroll and a second motor is operably connected to the second scroll.

18. The scroll device of claim 17, further comprising a controller for controlling an operating speed of the first motor and of the second motor.

* * * * *